US005891608A

United States Patent [19]

Hashimoto et al.

[11] Patent Number: 5,891,608

[45] Date of Patent: Apr. 6, 1999

[54] PHOTOGRAPHIC PROCESSING COMPOSITION IN SLURRY-FORM

[75] Inventors: Hiroshi Hashimoto; Kazuaki Yoshida, both of Kanagawa, Japan

[73] Assignee: Fuji Photo Film Co., Ltd., Minami-ashigara, Japan

[21] Appl. No.: 831,349

[22] Filed: Apr. 1, 1997

[30] Foreign Application Priority Data

Apr. 2, 1996 [JP] Japan ..... 8-104530

[51] Int. Cl.[6] ..... G03C 5/30

[52] U.S. Cl. ..... 430/458; 430/466

[58] Field of Search ..... 430/458, 466

[56] References Cited

U.S. PATENT DOCUMENTS

| | | | |
|---|---|---|---|
| 2,735,774 | 2/1956 | Henn | 430/453 |
| 2,784,086 | 3/1957 | Henn | 430/466 |
| 3,238,043 | 3/1966 | Levy | 430/458 |
| 3,607,277 | 9/1971 | Schranz | 430/351 |
| 4,045,228 | 8/1977 | Vanassche et al. | 430/411 |
| 4,872,885 | 10/1989 | Tsubakimoto et al. | 44/51 |
| 5,310,633 | 5/1994 | Yoshida et al. | 430/458 |

FOREIGN PATENT DOCUMENTS

| | | |
|---|---|---|
| 204372 | 12/1986 | European Pat. Off. . |
| 57-500485 | 3/1982 | Japan . |
| WO81/02934 | 10/1981 | WIPO . |
| WO91/17481 | 11/1991 | WIPO . |

*Primary Examiner*—Hoa Van Le
*Attorney, Agent, or Firm*—Burns, Doane, Swecker & Mathis, LLP

[57] ABSTRACT

In a slurry-form photographic processing composition, some of photographic processing components are dispersed in water in fine particulate form, and a water-soluble polymer is contained in an amount of 0.1–10% by weight based on the weight of the processing components. The slurry composition is compact, easy to take out of the container, well soluble, and free of degradation during long-term storage.

8 Claims, No Drawings

PHOTOGRAPHIC PROCESSING COMPOSITION IN SLURRY-FORM

BACKGROUND OF THE INVENTION

1. Field of the Invention

This invention relates to a photographic processing composition in concentrated slurry form for use in the processing of photographic silver halide photosensitive materials.

2. Prior Art

Photographic black-and-white silver halide photosensitive material after exposure is generally processed through the steps of development, fixation and washing, which use processing solutions such as black-and-white developer, fixer, and wash water. On the other hand, photographic color silver halide photosensitive material after exposure is generally processed through the steps of color development, delivering, washing, and stabilization, which use processing solutions such as color developer, bleaching solution, bleach-fixer, fixer, wash water, and stabilizing solution.

These processing solutions are prepared using various chemicals most of which are normally solid.

Some processing solutions must be prepared by the user prior to use. Since unskilled users must be taken into account, such formulations are delivered to the user in concentrate form which requires only a dilution step. Processing compositions in liquid state, however, lack compactness and give rise to liquid leakage and other problems during transportation.

Processing compositions in solid state meet the requirement of compactness. One typical processing composition in solid state is a powdery composition. Powdery processing compositions, however, suffer from problems of scattering, adhesion, and leftover of powder. Tableting and granulation were proposed to eliminate these problems. Processing compositions in tablet or granule form have the problem that if tablets or granules are formed to high hardness in order to prevent them from collapsing to cause dusting, they lose the ease of dissolution. Despite the advantage of compactness, solid processing compositions are cumbersome to handle, for example, a solution preparing step being required.

Paste-form photographic processing compositions were also proposed. For example, Publication of International Patent Application No. 57-500485 discloses a photographic processing concentrate comprising a discontinuous solid phase distributed in a continuous liquid phase, the solid phase comprising fine solid particles interlaced in the form of a stable three-dimensional reticulated structure imparting shear-rate thinning, and the liquid phase being present in an amount extremely smaller than the necessary amount to form a solution of the solid phase, but sufficient to impart paste-like consistency. Because of its high viscosity at low shear rate, this concentrate, however, has to be subjected to mechanical shear or extruded in order to take the contents (paste) out of the container for admission into a processor tank, with a special tool being required. Also because of its high viscosity at low shear rate, the paste mass is unsusceptible to fine division, substantially decelerating the rate of dissolution upon dilution. Once the paste is attached to the inner wall of a dissolving tank, dilution becomes quite difficult. Incompletely dissolved paste particles are entrained in the solution and will attach to photographic film, causing trouble. In this way, high viscosity at low shear rate makes it difficult to handle in preparation steps, resulting in low productivity.

U.S. Pat. No. 2,735,774 discloses a fixer concentrate having fixer components suspended in a water-soluble colloidal gel of alginate. U.S. Pat. No. 2,784,086 discloses a developer concentrate comprising fine powdery developing and alkaline agents in a concentration of 0.5 to 10% in water and suspended as a concentrate paste in a colloidal gel of a compound selected from alginic acid, alginic acid salts, and alginic acid esters. These concentrates, however, have high viscosity and require an operation of extruding the concentrate from the container by a mechanical force when it is to be admitted from the container into a dissolving tank of a processor. The concentrate attached to the inner wall of the container is more difficult to take out. Feed of an accurate amount of the concentrate is not expectable, resulting in considerable variations of photographic quality.

SUMMARY OF THE INVENTION

An object of the present invention is to provide a slurry-form photographic processing composition which has so low viscosity at a low shear rate that it can be easily taken out of the container and admitted into the processor. Another object of the present invention is to provide a slurry-form photographic processing composition having advantages including easy operation of transfer from the container to the processor, effective dissolution, no quality degradation during long-term storage, compactness, ease of handling, and high productivity.

These and other objects are attained by the present invention which provides a photographic processing composition in slurry form comprising photographic processing components, at least one of which is dispersed in a medium in fine particulate form, and 0.1 to 10% by weight based on the weight of the processing components of a water-soluble polymer.

Preferably, the slurry-form photographic processing composition has a viscosity of 0.1 to 100 poise as measured at 25° C. and a low shear rate by a Brookfield viscometer. Also preferably, an aqueous solution of 1% by weight of the water-soluble polymer has a viscosity of 1 to 150 poise as measured at 25° C. and a low shear rate by a Brookfield viscometer. The water-soluble polymer is typically a cellulosic resin, polyvinyl alcohol, polyvinyl pyrrolidone, acrylic resin, polystyrene sulfonate resin or a modified one thereof.

DESCRIPTION OF THE PREFERRED EMBODIMENTS

In a slurry-form photographic processing composition according to the present invention, some of photographic processing components are dispersed in a medium in fine particulate form, and a water-soluble polymer is present in an amount of 0.1 to 10% by weight based on the weight of the processing components. The composition is contained in a container for transportation and storage purposes.

Since the photographic processing composition of the invention is slurry, it has sufficient fluidity to flow out of the container (with its cap removed) merely when the container is inclined. The composition is thus very easy to take out of the container. As compared with the paste-form photographic processing compositions mentioned above, the slurry composition of the invention is superior in manipulation when the composition is to be admitted from the container into a developing processor. The invention eliminates a need for a special tool which is attached to the processor for assisting in taking out the contents from the container as required for the paste-form compositions. Additionally, with respect to the preparation of the processing composition itself, handling is easy and productivity is high.

As compared with ready-to-use solution, the slurry is reduced in volume and weight, contributing to substantial savings of transportation cost and storage space. The container may have a smaller volume. Reducing the volume of the container and hence, the quantity of resinous material to form containers is not only economical, but is also advantageous for environmental protection because of a less burden for the collection and disposal of used containers.

As compared with the paste-form compositions, the slurry composition of the invention featuring low viscosity is well soluble and eliminates the inconvenience of insoluble matter attaching to photographic film, ensuring production of photographs of quality.

As compared with the paste-form compositions, the slurry composition of the invention featuring low viscosity at low shear rate is smoothly and fully discharged from the container. The amount of the composition left in the container interior is minimized. The composition can be admitted into a processing tank in an accurate amount to minimize the variation of photographic quality caused by varying feed amounts, enabling to produce photographs of consistent quality.

As compared with the paste-form photographic processing concentrate of Publication of International Patent Application No. 57-500485 referred to above, the slurry composition of the invention does not solidify or allow sedimentation during long-term storage. There is provided a shelf-stable photographic processing composition.

In the slurry composition of the invention, a water-soluble polymer is contained in an amount of 0.1 to 10% by weight, preferably 0.2 to 5% by weight, based on the weight of the processing components. Contents of the water-soluble polymer in this range ensures that the composition forms a stable slurry, with which photographic material can be processed to satisfactory photographic quality. Less than 0.1% by weight of the water-soluble polymer allows a substantial amount of sediment to settle with the lapse of time whereas more than 10% by weight of the water-soluble polymer can deteriorate photographic quality and cause difficult discharge from the container.

Preferably, the slurry-form photographic processing composition of the invention has a viscosity of 0.1 poise to 100 poise, more preferably 1 poise to 50 poise as measured at 25° C. and a low shear rate by a Brookfield viscometer. It is noted that the low shear rate is a shear rate of 10 $sec^{-}$ or lower and that a viscosity at such a low shear rate can be measured by a Brookfield viscometer. A viscosity in the above-defined range ensures that the slurry composition has appropriate flow. A slurry with a viscosity of less than 0.1 poise would allow solid matter to settle, which is difficult to subsequently empty out of the container. A slurry with a viscosity of more than 100 poise would be less efficient to discharge from the container and to dissolve.

The water-soluble polymer used herein is described in detail.

The water-soluble polymers used herein include polymers obtained by polymerizing a monomer having a (co) polymerizable ethylenically unsaturated group alone or with another monomer, polyesters, polyamides, polyurethanes, polyethers, polycarbonates, naturally occurring high molecular weight compounds, and derivatives thereof. Preferred are polymers obtained by polymerizing a monomer having a copolymerizable ethylenically unsaturated group alone or with another monomer and polyethers.

The water-soluble polymers obtained by polymerizing a monomer having a copolymerizable ethylenically unsaturated group alone or with another monomer preferably have recurring units represented by the following general formulae (I) to (V).

A recurring unit having at least one hydroxyl group is of the general formula (I).

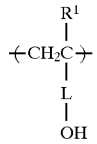

In formula (I), $R^1$ is a hydrogen atom or lower alkyl group having 1 to 4 carbon atoms, and L is a valence bond or a divalent linking group. L may have at least one hydroxyl substituent thereon.

More particularly, $R^1$ is a hydrogen atom or lower alkyl group of 1 to 4 carbon atoms such as methyl, ethyl and n-butyl, with the hydrogen and methyl being preferred. L is represented by $—(L^1)_{k1}-(L^2)_{k2}—$ wherein $L^1$ is —CON($R^2$)— wherein $R^2$ is a hydrogen atom, alkyl group of 1 to 4 carbon atoms or substituted alkyl group of 1 to 6 carbon atoms, —COO—, —NHCO—, —OCO—, or a group represented by the formula:

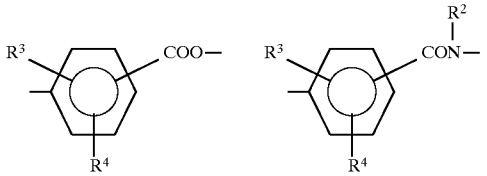

wherein $R^2$ is as defined above, $R^3$ and $R^4$ are independently selected from the group consisting of hydrogen, hydroxyl, halogen atom, substituted or unsubstituted alkyl, alkoxy, acyloxy, and aryloxy; $L^2$ is a group of linking $L^1$ to the hydroxyl group; k1 is equal to 0 or 1, and k2 is equal to 0 or 1.

The linking group of $L^2$ is represented by the general formula: $—[X^1—(J^2—X^2)_p—(J^2—X^3)_q—(J^3)_r]_s—$ wherein $J^1$, $J^2$, and $J^3$ which may be identical or different are selected from —CO—, —$SO_2$—, —CON($R^5$)— wherein $R^5$ is a hydrogen atom, alkyl group of 1 to 6 carbon atoms or substituted alkyl group of 1 to 6 carbon atoms, —$SO_2$N($R^5$)— wherein $R^5$ is as defined above, —N($R^5$)—$R^6$— wherein $R^5$ is as defined above and $R^6$ is an alkylene group of 1 to 4 carbon atoms, —N($R^5$)—$R^6$—N($R^7$)— wherein $R^5$ and $R^6$ are as defined above and $R^7$ is a hydrogen atom, alkyl group of 1 to 6 carbon atoms or substituted alkyl group of 1 to 6 carbon atoms, —O—, —S—, —N($R^5$)—CO—N($R^7$)— wherein $R^5$ and $R^7$ are as defined above, —N($R^5$)—$SO_2$—N($R^7$)— wherein $R^5$ and $R^7$ are as defined above, —COO—, —OCO—, —N($R^5$)$CO_2$— wherein $R^5$ is as defined above, and —N($R^5$)CO— wherein $R^5$ is as defined above; $X^1$, $X^2$, and $X^3$ which may be identical or different are selected from substituted or unsubstituted alkylene, substituted or unsubstituted arylene, substituted or unsubstituted aralkylene groups; letter p is an integer of 0 to 50, each of q, r, and s is equal to 0 or 1.

More particularly, $X^1$, $X^2$, and $X^3$ may be identical or different and represent substituted or unsubstituted alkylene, aralkylene or phenylene groups of 1 to 10 carbon atoms. The alkylene groups may be linear or branched. Exemplary alkylene groups include methylmethylene, dimethylmethylene, dimethylene, trimethylene, tetramethylene, pentamethylene, hexamethylene, and decylmethylene; exemplary aralkylene groups include benzylidene; and exemplary phenylene groups include p-phenylene, m-phenylene, and methylphenylene.

Substituents on the alkylene, aralkylene or phenylene groups represented by $X^1$, $X^2$, and $X^3$ include halogen atom, nitro, cyano, alkyl, substituted alkyl, alkoxy, substituted alkoxy, —$NHCOR^8$ wherein $R^8$ is alkyl, substituted alkyl, phenyl, substituted phenyl, aralkyl, or substituted aralkyl, —$NHSO_2R^8$ wherein $R^8$ is as defined above, —$SOR^8$ wherein $R^8$ is as defined above, —$COR^8$ wherein $R^8$ is as defined above, —$CON(R^9)(R^{10})$ wherein $R^9$ and $R^{10}$ which may be identical or different are hydrogen atom, alkyl, substituted alkyl, phenyl, substituted phenyl, aralkyl, or substituted aralkyl, —$SO_2N(R^9)(R^{10})$ wherein $R^9$ and $R^{10}$ are as defined above, amino group which may have an alkyl substituent, hydroxyl group, and groups hydrolyzable to form a hydroxyl group. Where more than one substituent is present, they may be identical or different.

Exemplary substituents of the substituted alkyl, substituted alkoxy, substituted phenyl, and substituted aralkyl groups are a hydroxyl group, nitro group, alkoxy groups of 1 to 4 carbon atoms, groups represented by —$NHSO_2R^8$, —$NHCOR^8$, —$SO_2N(R^9)(R^{10})$, —$CON(R^9)(R^{10})$, —$SOR^8$, and —$COR^8$ wherein $R^8$, $R^9$ and $R^{10}$ are as defined above, halogen atoms, cyano group, and amino groups which may have an alkyl substituent.

Examples of the recurring unit having at least one hydroxyl group are shown below though not limited thereto.

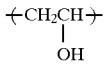

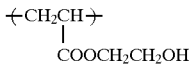

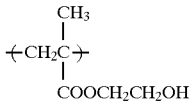

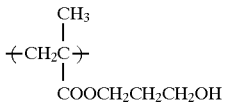

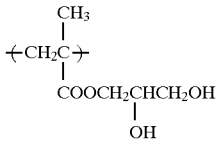

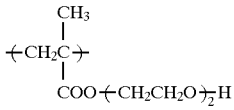

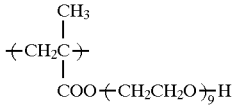

-continued

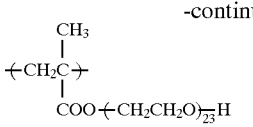

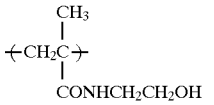

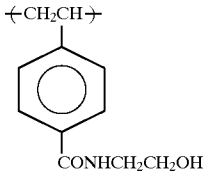

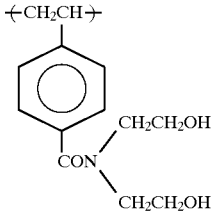

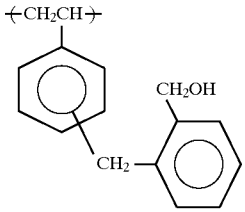

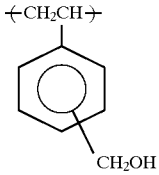

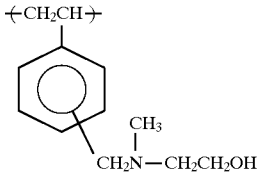

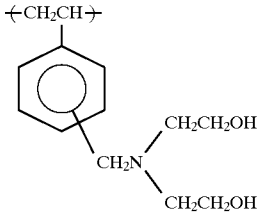

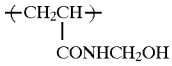

Such recurring units having at least one hydroxyl group are obtained in various ways, for example, by polymerizing an ethylenically unsaturated monomer having a hydroxyl group, or by once polymerizing an ethylenically unsaturated monomer capable of providing a hydroxyl group through such reaction as hydrolysis (for example, vinyl acetate) and effecting high molecular reaction (e.g., hydrolysis) to convert into a hydroxyl group as is well known for the preparation of polyvinyl alcohol.

A recurring unit having an anionic functional group is of the general formula (II).

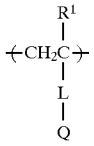

In formula (II), $R^1$ and L are as defined in formula (I).

L may have at least one substituent Q. Q is an anionic functional group, for example, groups represented by —COOH, —$SO_3H$, —$SO_2H$, —OP(=O) $(OH)_2$ (or a monoalkyl ester group thereof), and —$OSO_3H$. These anionic groups may take the form of salts, for example, alkali metal salts (e.g., Na and K salts), ammonium salts (e.g., salts with ammonia, methylamine, and dimethylamine). The anionic groups may also take the form of acid anhydrides.

Illustrative, non-limiting examples of the ethylenically unsaturated monomer having an anionic functional group are shown below in a non-dissociated form.

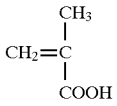

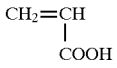

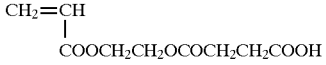

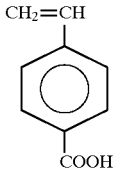

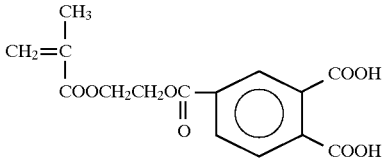

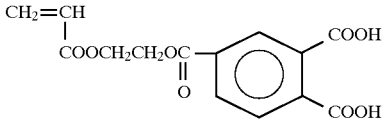

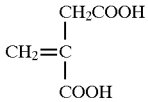

-continued

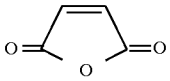

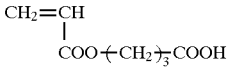

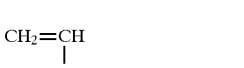

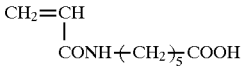

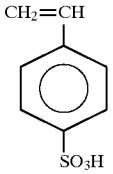

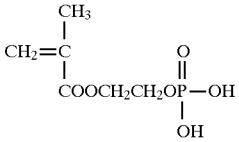

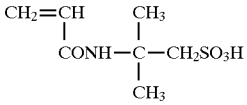

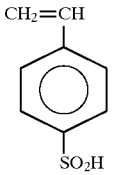

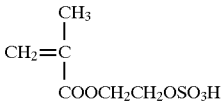

A recurring unit having an amide linkage is of the general formula (III).

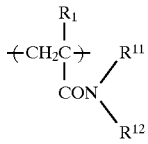

In formula (III), $R^1$ is as defined in formula (I), $R^{11}$ and $R^{12}$ are selected from a hydrogen atom, alkyl group of 1 to 8 carbon atoms (inclusive of substituted ones), and aryl groups of 6 to 14 carbon atoms (inclusive of substituted ones), or $R^{11}$ and $R^{12}$, taken together, may form a ring structure.

More particularly, $R^{11}$ and $R^{12}$ may be identical or different and selected from a hydrogen atom, alkyl groups of 1 to 8 carbon atoms such as methyl, ethyl, hydroxyethyl, butyl, and n-hexyl, and aryl groups of 6 to 14 carbon atoms such as phenyl, methoxyphenyl and chlorophenyl. Among these, hydrogen, alkyl groups of 1 to 4 carbon atoms, and aryl groups of 6 to 10 carbon atoms are preferred, with the hydrogen, methyl, ethyl, and hydroxyethyl groups being especially preferred. Most preferably, at least either one of $R^{11}$ and $R^{12}$ is a hydrogen atom.

When $R^{11}$ and $R^{12}$, taken together, form a ring structure, the ring is preferably a 5 to 7-membered ring. Preferred examples of the ring structure are pyridine, piperidine, morpholine, and piperazine rings. The ring structure may have a substituent.

Another recurring unit having an amide linkage is of the general formula (IV).

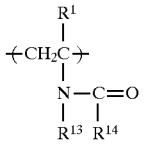

In formula (IV), $R^1$ is as defined in formula (I), $R^{13}$ and $R^{14}$ are selected from a hydrogen atom and alkyl group of 1 to 8 carbon atoms (inclusive of substituted ones), or $R^{13}$ and $R^{14}$, taken together, may form a lactam, oxazolidone or pyridone ring which may have a substituent.

More particularly, $R^{13}$ and $R^{14}$ may be identical or different and selected from a hydrogen atom, alkyl groups of 1 to 8 carbon atoms such as methyl, ethyl, hydroxyethyl, butyl, and n-hexyl. Alternatively, $R^{13}$ and $R^{14}$, taken together, form 5 to 7-membered lactam rings (e.g., γ-lactam, δ-lactam and ϵ-lactam), 5 to 7-membered oxazolidone rings or 5 to 7-membered pyridone rings. Among these, hydrogen, methyl, ethyl, and groups forming a pyridone or oxazolidone ring are especially preferred.

A further recurring unit having an amide linkage is of the general formula (V).

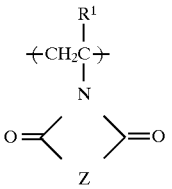

In formula (V), $R^1$ is as defined in formula (I), and Z is a group of atoms necessary to form a 5 to 7-membered ring structure which may have a substituent.

Preferably, Z is a group of atoms necessary to form a 5 or 6-membered ring structure, for example, succinimide, malonimide and phthalimide rings, especially a succinimide ring.

Preferred examples of the recurring unit having an amide bond which can be used herein are shown below though not limited thereto.

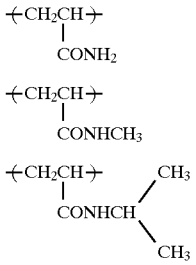

-continued

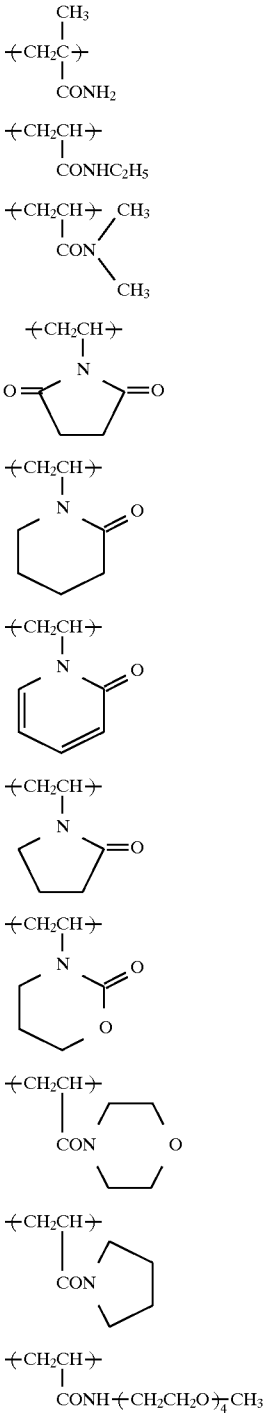

The water-soluble polymers having recurring units of general formulae (I) to (V) may be homopolymers or copolymers having at least two types of recurring units of formulae (I) to (V), or copolymers having at least two different recurring units of the same general formula.

The polymers may be copolymers with another monomer having an ethylenically unsaturated bond insofar as the solubility of the polymer in water or alkaline aqueous solution is not impaired.

Examples of the copolymerizable monomer having an ethylenically unsaturated bond include monomers capable of providing recurring units of formulae (I) to (V), esters derived from acrylic acids such as acrylic acid, α-chloroacrylic acid, and α-alkylacrylic acids (e.g., methacrylic acid), for example, methyl acrylate, ethyl acrylate, n-propyl acrylate, n-butyl acrylate, t-butyl acrylate, isobutyl acrylate, 2-butylhexyl acrylate, n-octyl acrylate, lauryl acrylate, methyl methacrylate, ethyl methacrylate, n-butyl methacrylate, cyclohexyl methacrylate, β-alkoxyethyl (meth)acrylates (e.g., 2-methoxyethyl acrylate, 2-methoxyethyl methacrylate, 2-methoxyethyl acrylate, 2-ethoxyethyl acrylate, 2-ethoxyethyl methacrylate, 2-butoxyethyl acrylate, 2-n-propyloxyethyl methacrylate, 2-(2-methoxy)ethoxyethyl acrylate, etc.), β-sulfonamidoethyl (meth)acrylate, β-carbonamidoethyl (meth)acrylate, compounds represented by the formula:

$$CH_2{=}CH{-}COO{-}(CH_2CH_2O)_n{-}CH_3$$

wherein n is 2 to 50, compounds represented by the formula:

$$CH_2{=}C(CH_3){-}COO{-}(CH_2CH_2O)_n{-}CH_3$$

wherein n is 2 to 50, vinyl esters (e.g., vinyl acetate and vinyl laurate), acrylonitrile, methacrylonitrile, dienes (e.g., butadiene and isoprene), aromatic vinyl compounds (e.g., styrene, divinylbenzene and derivatives thereof such as vinyltoluene, vinylacetophenone, and sulfostyrene), itaconic acid, citraconic acid, crotonic acid, vinylidene chloride, vinyl alkyl ethers (e.g., vinyl ethyl ether), maleic anhydride, maleic esters, maleic amides, N-vinylpyridine, 2- and 4-vinylpyridine, ethylene, propylene, 1-butene, and isobutene. Among these monomers, preferred are monomers whose homopolymers are soluble in water or alkaline aqueous solution, especially ethylenically unsaturated monomers having an anionic dissociatable group.

The copolymerizing ratio of the recurring units of general formulae (I) to (V) to the recurrent units derived from the other monomer varies depending on the polarity and water solubility of monomer components used. Preferably, the copolymers contain 10 to 100 mol %, more preferably 30 to 100 mol % of the recurring units of general formulae (I) to (V).

Where compounds having the recurring units of general formulae (I) to (V) are used as a copolymer, the copolymers may be random copolymers well known in conjunction with general radical polymerization reaction, graft copolymers, or block copolymers as described in JP-A 240763/1985.

Polymers having the recurring units of general formulae (I) to (V) can be synthesized by well-known techniques, for example, solution polymerization, suspension polymerization, emulsion polymerization, precipitation polymerization, dispersion polymerization, and bulk polymerization. For the detail, reference is made to UKP 1,211,039, JP-B 29195/1972, JP-A 76593/1973, 92022/1973, 21134/1974, 120634/1974, UKP 961,395, U.S. Pat. Nos. 3,227,672, 3,290,417, 3,262,919, 3,245,932, 2,681,897, 3,230,293, John C. Petropoulos et al, "Official Digest," vol. 33, pp. 719–736 (1961), Murahashi Ed., "Synthetic Polymers," vol. 1, pages 246–290, vol. 3, pages 1–108. Depending on a particular purpose, a polymerization initiator, concentration, polymerizing temperature, reaction time, and other parameters may, of course, be selected or changed from a wide range. For example, polymerization of a monomer is carried out at a temperature of 20° to 150° C., preferably 40° to 120° C. in the presence of 0.05 to 5% by weight of a radical polymerization initiator based on the weight of the monomer. The initiators used herein include azobis compounds, peroxides, hydroperoxides, and redox catalysts, for example, potassium persulfate, tert-butylperoctoate, benzoyl peroxide, azobisisobutyronitrile, 2,2'-azobiscyanovaleric acid, and 2,2'-azobis-(2-amidinopropane hydrochloride).

Described below are the polyether compounds which are advantageously used as the water-soluble polymer in the practice of the invention. The polyether compounds preferably have recurring units of the following general formula (VI).

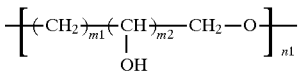

In formula (VI), m1 is an integer of 1 to 3, m2 is equal to 0 or 1, and n1 is an integer of 2 to 100. Preferably, n1 is 10 to 40, especially 15 to 30, and m2 is 0.

Those compounds of formula (VI) wherein m1=1, m2=0, and n1=15 to 30 are preferred.

Also useful in the practice of the invention are water-soluble polyamides, polyurethanes, and polycarbonates. They have an anionic functional group (corresponding to Q in general formula (II)) or cationic functional group (which is a group represented by general formula (VII) shown below) in their backbone and/or side chain. Polymers having an anionic functional group are especially preferred.

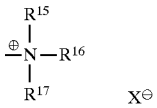

In formula (VII), $R^{15}$, $R^{16}$ and $R^{17}$, which may be identical or different, each are a hydrogen atom or lower alkyl group of 1 to 4 carbon atoms. These lower alkyl group may have another functional group substituted thereon.

More particularly, $R^{15}$, $R^{16}$ and $R^{17}$ each are a hydrogen atom or lower alkyl group of 1 to 4 carbon atoms such as methyl, ethyl, propyl, butyl, 2-cyanoethyl, 2-hydroxyethyl, and 2-carboxyethyl, with the hydrogen, methyl and hydroxyethyl being preferred. It is most preferred that at least one of $R^{15}$, $R^{16}$ and $R^{17}$ is a hydrogen atom.

The water-soluble naturally occurring high molecular weight derivatives which are preferably used in the practice of the invention include, for example, gelatin, gelatin derivatives (e.g., acylated gelatin and alkylated gelatin), graft polymers of gelatin with another polymer; proteins such as albumin and casein and derivatives thereof; cellulose derivatives such as hydroxyethyl cellulose, carboxymethyl cellulose, cellulose sulfate and salts thereof; saccharide derivatives such as dextran, saccharose, and pluran.

Illustrative, non-limiting, examples of the recurring unit having at least one hydroxyl group are given below.

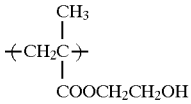

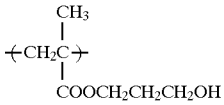

-continued

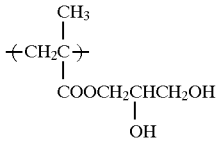

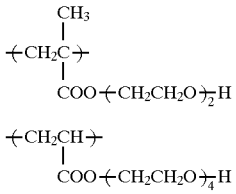

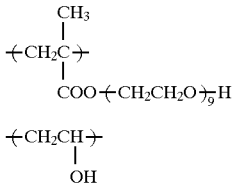

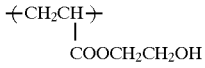

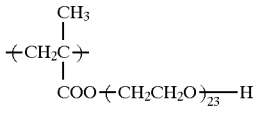

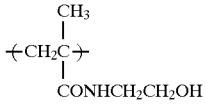

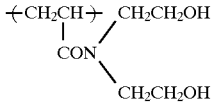

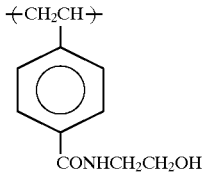

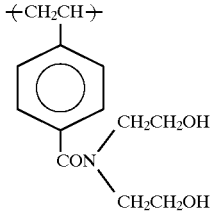

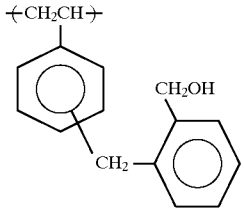

Typical examples of typical water-soluble polymer which can be used herein are shown below although the invention is not limited thereto.

| | |
|---|---|
| EX-1 | polyvinyl alcohol (saponification 98.5%) |
| EX-2 | polyvinyl alcohol (saponification 74.0%) |
| EX-3 | polyvinyl alcohol-polyacrylic acid block copolymer (100/50 weight ratio) |
| EX-4 | polyvinyl alcohol-poly(acrylic acid-CO-methacrylic acid) block copolymer (110/40/10 weight ratio) |
| EX-5 | polyvinyl alcohol-polyacrylamide block copolymer (100/100 weight ratio) |
| EX-6 | 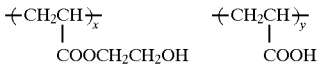 x/y = 60/40 (weight ratio) |
| EX-7 | 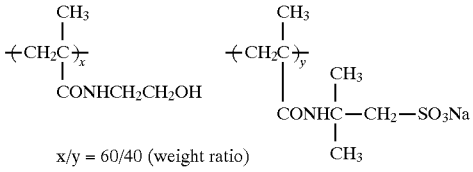 x/y = 60/40 (weight ratio) |
| EX-8 | 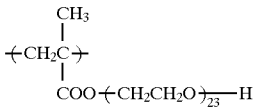 |
| EX-9 | 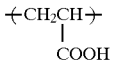 |
| EX-10 | 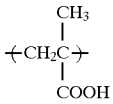 |
| EX-11 | 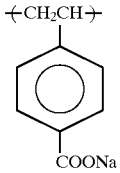 |
| EX-12 | 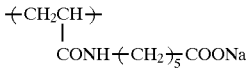 |
| EX-13 | 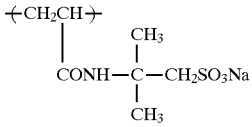 |
| EX-14 | 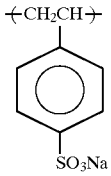 |
| EX-15 | 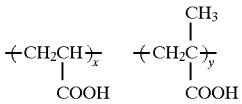 x/y = 50/50 (weight ratio) |

-continued

EX-16

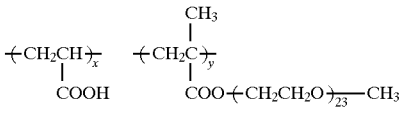

x/y = 95/5 (weight ratio)

EX-17

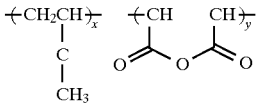

x/y = 50/50 (weight ratio)

EX-18

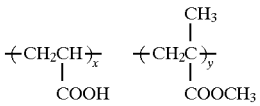

x/y = 90/10 (weight ratio)

EX-19

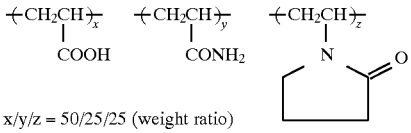

x/y/z = 50/25/25 (weight ratio)

EX-20

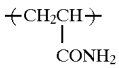

EX-21

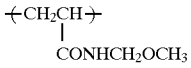

EX-22

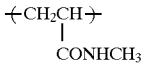

EX-23

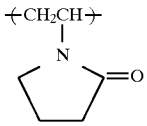

EX-24

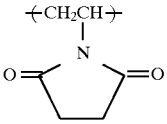

EX-25

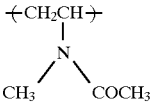

EX-26

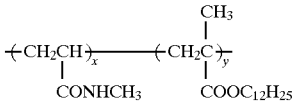

x/y = 90/10 (weight ratio)

EX-27

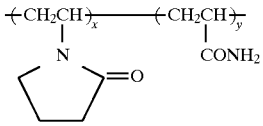

x/y = 50/50 (weight ratio)

-continued

EX-28

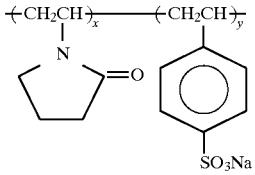

x/y = 80/20 (weight ratio)

EX-29

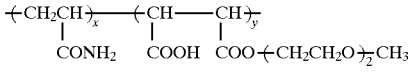

x/y = 75/25 (weight ratio)

EX-30

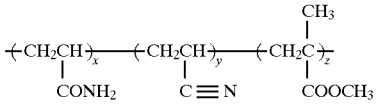

x/y/z = 85/10/5 (weight ratio)

EX-31

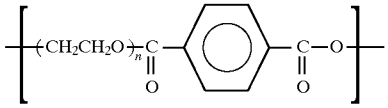

n =20

EX-32

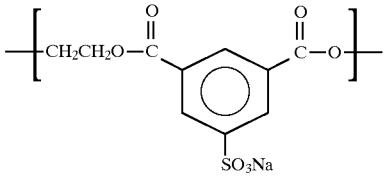

EX-33

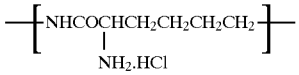

EX-34

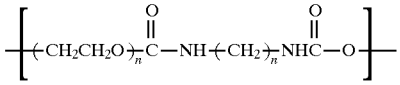

n = 35

EX-35

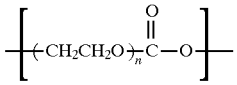

n = 13

| | |
|---|---|
| EX-36 | poly(ethylene oxide) average degree of polymerization 50 |
| EX-37 | poly(ethylene oxide) average degree of polymerization 20 |
| EX-38 | gelatin |
| EX-39 | casein |
| EX-40 | 2-hydroxyethyl cellulose |
| EX-41 | carboxymethyl cellulose |
| EX-42 | sodium salt of cellulose sulfate |
| EX-43 | dextran |
| EX-44 | water-soluble starch |

Preferred among the aforementioned examples of the water-soluble polymer are cellulosic resins including alkali metal salts of carboxymethyl cellulose such as sodium carboxymethyl cellulose, hydroxyethyl cellulose, and methyl cellulose;

polyvinyl alcohol;

polyvinyl pyrrolidone;

acrylic resins including alkali metal salts of polyacrylic acid and polymethacrylic acid such as sodium polyacrylate and sodium polymethacrylate;

polystyrene sulfonate resins including alkali metal salts of polystyrene sulfonic acid such as sodium polystyrene sulfonate; and modified products of the foregoing resins.

Carboxymethyl cellulose and its modified products such as alkali metal salts of carboxymethyl cellulose are especially preferred, with those having a degree of etherification of at least 0.6, further at least 0.8, especially 1.0 to 2.0 being more preferred. The benefits of the invention become greater by selecting a degree of etherification within the preferred range.

The degree of etherification is a value representing the proportion of a substituent (carboxymethyl group in this example) on three hydroxyl groups per glucose unit. Therefore, the minimum is 0 and the maximum is 3 when all the hydroxyl groups are substituted.

It is understood that a degree of etherification is given by quantitative determination of a carboxyl group. The quantity of a carboxyl group may be determined in various ways by, for example, (1) immersing a sample in a solution of 0.01N $NaHCO_3$ and 0.1N NaCl, passing the solution through a filter, and determining the quantity of $NaHCO_3$ left in the filtrate (TAPPI Standards T237, su-63), (2) measuring the amount of Methylene Blue absorbed to a carboxyl group (TAPPI Standards T237, su-63), (3) using a NaOH-NaCl solution (D. E. Stecheschulte, K. F. Austen, J. Immunol, 104, 1052 (1970)), and (4) using Crystal Violet (S. E. Svehag, B. Chesebro, Science, 158, 938 (1967)).

The water-soluble polymer preferably has a degree of polymerization of about 500 to 3,500, more preferably about 1,000 to 2,500 and a weight average molecular weight of about 20,000 to 1,000,000, more preferably about 40,000 to 500,000. A polymer having such a degree of polymerization allows the composition to have appropriate viscosity. Outside the above-defined range, a polymer with a lower degree of polymerization would be less effective for stabilizing dispersion, allowing a sediment to form with the lapse of time. A polymer with a greater degree of polymerization would render a slurry composition too viscous to discharge from the container or be dissolved in water.

Also, the water-soluble polymer in a 1 wt % aqueous solution form should preferably have a viscosity of 1 poise to 150 poise, more preferably 10 poise to 100 poise as measured at 25° C. and a low shear rate by a Brookfield viscometer. Using a water-soluble polymer having such a viscosity, a slurry composition having appropriate viscosity can be prepared. It is believed that the alginate esters and analogues disclosed in U.S. Pat. Nos. 2,735,774 and 2,784,086 have a higher viscosity than the water-soluble polymer according to the invention.

In the slurry-form photographic processing composition according to the invention, some of photographic processing components are dispersed in a medium in fine particulate form. Fine particles may take any desired shape including spherical, needle and irregular shapes. They preferably have a mean particle size of up to 100 μm, more preferably up to 30 μm. With such a limited size, the dispersion stability of fine particles in slurry is improved to prevent precipitation. With a larger particle size, the dispersion stability would lower, allowing for sedimentation and solidification. Although the lower limit of mean particle size is not critical, it is preferred to set a lower limit of 0.01 μm because excess energy is needed to pulverize raw material powder into microparticulates. Therefore, fine particles preferably have a mean particle size of 0.01 μm to 100 μm, more preferably 0.1 μm to 30 μm. In the case of needle particles, the mean particle size corresponds to a mean major axis length. The mean particle size or mean major axis length is determined by means of a scanning electron microscope (SEM). Except for needle particles, the mean particle size of non-spherical particles is calculated as a diameter of an equivalent circle obtained by projecting particles on a plane and converting the projected area into a circle.

For the slurry-form photographic processing composition according to the invention, the dispersing medium is typically water. Such water is present as an aqueous solution in which some of photographic processing components are dissolved. The amount of water is preferably 50 to 250% by weight, preferably 100 to 200% by weight, based on the weight of the processing components. With a less amount of water, the slurry composition would have high viscosity at low shear rate and thus be less easy to take out of the container. A slurry composition containing an excess of water is less dispersion stable and allows a sediment to settle with time.

The slurry-form photographic processing composition according to the invention is such that fine solid particles are uniformly dispersed in the slurry. The proportion of fine solid particles is preferably about 5 to 50% by weight, more preferably 8 to 30% by weight of the slurry.

In the slurry-form photographic processing composition according to the invention, some photographic processing components to be dispersed in fine particulate form include, in the case of color developer, for example, developing agents such as 2-methyl-4-[ethyl-N-(β-hydroxyethyl) amino]-aniline hydrogen sulfate, which is generally present as needle crystals having a mean major axis length of about 30 μm and a mean minor axis length of about 0.8 μm. Also included are hydroxylamine derivatives in developers such as disodium N,N-bis(sulfonatoethyl)hydroxylamine, which is generally present as needle crystals having a mean major axis length of about 20 to 50 μm and a mean minor axis length of about 5 to 10 μm. Other particulate components are triazinyldiaminostilbene brighteners in color developers for color paper, which are commercially available as Hakkol FWA-SF by Showa Chemicals K.K., UVITEX CK by Ciba Geigy, and WHITEX-4 by Sumitomo Chemicals K.K. These brighteners are of irregular shape and have a mean particle size of about 20 to 50 μm.

The slurry-form photographic processing composition according to the invention is prepared, for example, by admitting solid ones of photographic processing components into a kneader or dispersing machine such as a twin-arm open kneader, continuous kneader and Henschel mixer where they are pulverized and mixed. Then water is added in an amount of about 20 to 100% by weight of the solid components. Kneading is continued until a uniform paste is obtained. The paste is then gradually diluted with water until a uniform slurry is obtained. The final amount of water is as defined above.

The water-soluble polymer in powder form may be added at the same time as the solid components. Alternatively, the water-soluble polymer is dissolved in water to form an aqueous solution which is added to the solid components after pulverization and mixing thereof.

The slurry composition of the invention is compact in that its volume corresponds to 10 to 30% of the volume of ready-to-use solution and 20 to 60% of the volume of currently available concentrates.

For containing the slurry composition, conventional containers may be used, for example, polyethylene and other plastic bottles having an interior volume of about 0.5 to 5 liters.

On use, the slurry composition of the invention is diluted with water by a factor of about 3 to 10, preferably about 4 to 8 in volume to form a ready-to-use solution. As a result of dilution, those photographic processing components which have been present as fine particles are eventually dissolved to form a homogeneous solution.

The slurry composition of the invention may be any photographic processing composition insofar as it contains components which are present in fine particulate form. Therefore, the slurry composition is useful in preparing any desired one of various processing solutions such as color developers, black-and-white developers, and fixers. It is recommended to apply the slurry composition to color developers.

Described below are the color developer and color developer replenisher to which the invention is applicable.

The color developer and color developer replenisher contain well-known aromatic primary amine color developing agents. Preferred color developing agents are p-phenylenediamine derivatives. Typical examples include N,N-diethyl-p-phenylenediamine, 2-amino-5-diethylaminotoluene, 2-amino-5-(N-ethyl-N-laurylamino) toluene, 4-[N-ethyl-N-(β-hydroxyethyl)amino]aniline, 2-methyl-4-[N-ethyl-N-(β-hydroxyethyl)amino]aniline, 2-methyl-4-[N-ethyl-N-(β-hydroxybutyl)amino]aniline, 4-amino-3-methyl-N-ethyl-N-[β-(methanesulfonamido) ethyl]aniline, N-(2-amino-5-diethyl-aminophenylethyl) methanesulfonamide, N,N-dimethyl-p-phenylenediamine, 4-amino-3-methyl-N-ethyl-N-methoxyethyl-aniline, 4-amino-3-methyl-N-ethyl-N-β-ethoxyethylaniline, and 4-amino-3-methyl-N-ethyl-N-β-butoxyethylaniline. Especially preferred are 4-amino-3-methyl-N-ethyl-N-[β-(methanesulfonamido)ethyl]aniline and 2-methyl-4-[N-ethyl-N-(β-hydroxybutyl)amino]aniline. These p-phenylenediamine derivatives may also be salts with sulfuric acid, hydrochloric acid, sulfurous acid, and p-toluenesulfonic acid. These compounds may be used in admixture of two or more if desired.

The aromatic primary amine color developing agent is typically used in an amount of about 4 to 50 mmol per liter of the color developer. In the case of color developer replenisher, the color developing agent is preferably used in an amount of about 21 to 65 mmol, more preferably about 28 to 55 mmol per liter of the replenisher.

In the practice of the invention, it is preferred that the color developer and color developer replenisher be substantially free of benzyl alcohol, from the standpoints of preventing precipitation from occurring in the replenisher and a variation of photographic properties from occurring with a variation of the quantity of photosensitive material being processed. The term "substantially free" means a benzyl alcohol concentration of less than 2 ml/liter, more preferably less than 0.5 ml/liter. Most preferably the replenisher or developer is free of benzyl alcohol.

In the practice of the invention, it is preferred that the color developer and color developer replenisher be substantially free of sulfite and hydroxylamine, from the standpoints of improving the solubility of the slurry processing composition and preventing a variation of photographic properties from occurring with a variation of the quantity of photosensitive material being processed. The term "substantially free" means a sulfite and hydroxylamine concentration of less than 4 mmol/liter, more preferably less than 2 mmol/liter. Most preferably the replenisher or developer is free of sulfite and hydroxylamine.

From the standpoints of improving the solubility of the slurry processing composition and preventing a variation of photographic properties from occurring with a variation of the quantity of photosensitive material being processed, it is preferred that the color developer and color developer replenisher contain a compound of the following general formula (H) as a preservative.

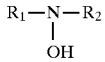

(H)

In formula (H), $R_1$ and $R_2$ each are a hydrogen atom, substituted or unsubstituted alkyl group, substituted or unsubstituted alkenyl group, substituted or unsubstituted aryl group or hetero-aromatic group. It is excluded that both $R_1$ and $R_2$ are hydrogen atoms at the same time. Alternatively, $R_1$ and $R_2$, taken together, form a heterocyclic ring with the nitrogen atom. The heterocyclic structure is typically a 5- or 6-membered ring which is constructed by carbon, hydrogen, halogen, oxygen, nitrogen and/or sulfur atoms and may be either saturated or unsaturated.

Most often, $R_1$ and $R_2$ are alkyl or alkenyl groups, preferably having 1 to 10 carbon atoms, especially 1 to 5 carbon atoms. The nitrogenous heterocyclic rings formed by $R_1$ and $R_2$, taken together, include piperidyl, pyrrolidinyl, N-alkylpiperazyl, morpholyl, indolinyl, and benzotriazole groups.

Illustrative, non-limiting, examples of the compound of formula (H) are given below.

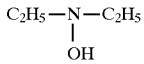

H-1

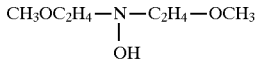

H-2

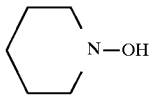

H-3

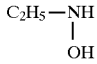

H-4

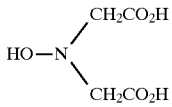

H-5

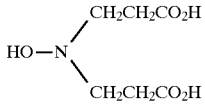

H-6

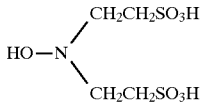

H-7

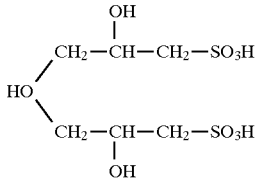

H-8

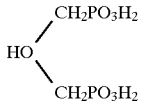

H-9

-continued

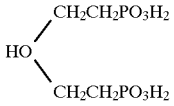
H-10

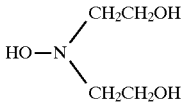
H-11

$HO-NH-CH_2CO_2H$ H-12

$HO-NH-CH_2CH_2SO_3H$ H-13

$HO-NH-CH_2PO_3H$ H-14

$HO-NH-CH_2CH_2OH$ H-15

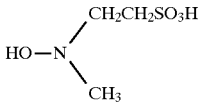
H-16

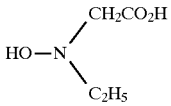
H-17

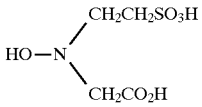
H-18

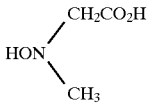
H-19

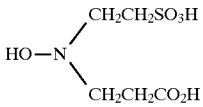
H-20

The compounds of formula (H) may be used alone or in admixture of two or more. These compounds are preferably added to the color developer and color developer replenisher in an amount of 0.005 to 0.5 mol/liter, more preferably 0.03 to 0.1 mol/liter.

The compounds of formula (H) can be synthesized by subjecting commercially available hydroxylamines to alkylation reaction (nucleophilic substitution reaction, addition reaction or Mannich reaction). For example, synthesis can be done according to the methods of W. German Patent No. 1,159,634 and Inorganica Chimica Acta., 93 (1984), pp. 101–108. Exemplary procedures are described below.

Synthetic Example

Synthesis of compound (H-17)

To 200 ml of an aqueous solution of 20 grams hydroxylamine hydrochloride were added 11.5 grams of sodium hydroxide and 96 grams of sodium chloroethanesulfonate. To the solution kept at 60° C., 40 ml of an aqueous solution of 23 grams sodium hydroxide was slowly added over one hour. The solution was kept at 60° C. for 3 hours. The reaction solution was concentrated in vacuum, and 200 ml of conc. hydrochloric acid was added to the concentrate, which was heated to 50° C. Insoluble matter was filtered off and 500 ml of methanol was added to the filtrate, yielding the end product, compound (H-17), as monosodium salt crystals. The amount was 41 grams (yield 53%).

Synthesis of compound (H-11)

Formalin, 32.6 grams, was added to an aqueous hydrochloric acid solution containing 7.2 grams of hydroxylamine hydrochloride and 18.0 grams of phosphorous acid, which was heated under reflux for 2 hours. The resulting crystals were recrystallized from water and methanol, obtaining 9.2 grams (42%) of the end product, compound (H-11).

In the practice of the invention, another organic preservative may be added to the color developer and color developer replenisher in addition to the compound of formula (H).

The term organic preservative is used to encompass all organic compounds which when added to processing solutions for color photographic photosensitive materials, function to decelerate the rate of degradation of aromatic primary amine color developing agents. That is, the organic preservative includes organic compounds having a function of preventing oxidation of color developing agents by air. Especially effective organic preservatives are hydroxamic acids, hydrazines, hydrazides, phenols, α-hydroxyketones, α-aminoketones, saccharides, monoamines, diamines, polyamines, quaternary ammonium salts, nitroxyl radicals, alcohols, oximes, diamides, and fused ring type amines. They are disclosed in JP-B 30496/1973, JP-A 143020/1977, 4235/1988, 30845/1988, 21647/1988, 44655/1988, 53551/1988, 43140/1988, 56654/1988, 58346/1988, 43138/1988, 146041/1988, 44657/1988, 44656/1988, 97953/1989, 186939/1989, 186940/1989, 187557/1989, 306244/1990, U.S. Pat. Nos. 3,615,503 and 2,494,903. Other useful preservatives are metals as disclosed in JP-A 44148/1982 and 53749/1982, salicylic acids as disclosed in JP-A 180588/1984, amines as disclosed in JP-A 239447/1988, 128340/1988, 186939/1989, and 187557/1989, alkanolamines as disclosed in JP-A 3532/1979, polyethylene imines as disclosed in JP-A 94349/1981, and aromatic polyhydroxy compounds as disclosed in U.S. Pat. No. 3,746,544. Addition of alkanolamines such as triethanolamine is especially preferred.

In the practice of the invention, addition of aromatic polyhydroxy compounds to the developer is preferred for improving the stability thereof. The aromatic polyhydroxy compounds are generally compounds having two hydroxyl groups on an aromatic ring at relative ortho-positions. Preferred aromatic polyhydroxy compounds are compounds having at least two hydroxyl groups on an aromatic ring at relative ortho-positions and free of unsaturation outside the ring. Included in a wide range of aromatic polyhydroxy compounds which can be used herein are benzene and naphthalene compounds.

Examples of the aromatic polyhydroxy compound which can be used herein are given below.

| | |
|---|---|
| N-1 | pyrocatechol |
| N-2 | 4,5-dihydroxy-m-benzene-1,3-disulfonic acid |
| N-3 | disodium 4,5-dihydroxy-m-benzene-1,3-disulfonate |
| N-4 | tetrabromopyrocatechol |
| N-5 | pyrogallol |
| N-6 | sodium 5,6-dihydroxy-1,2,4-benzenetrisulfonate |
| N-7 | gallic acid |
| N-8 | methyl gallate |
| N-9 | propyl gallate |
| N-10 | 2,3-dihydroxynaphthalene-6-sulfonic acid |
| N-11 | 2,3,8-trihydroxynaphthalene-6-sulfonic acid |

These compounds may be used alone or in admixture of two or more. They may be added to the color developer or color developer replenisher in an amount of 0.00005 to 0.1 mol/liter, usually 0.0002 to 0.04 mol/liter, preferably 0.0002 to 0.004 mol/liter of the developer.

The color developer is preferably adjusted to pH 9 to 12, more preferably pH 9 to 11.0. The color developer may contain other well-known developer components. The color developer replenisher is preferably adjusted to pH 11 to 14, more preferably pH 11.5 to 13.5.

To maintain such pH, buffer agents are preferably used. Exemplary buffer agents include carbonate salts, phosphate salts, borate salts, tetraborate salts, hydroxybenzoate salts, glycyl salts, N,N-dimethylglycine salts, leucine salts, norleucine salts, guanine salts, 3,4-dihydroxy-phenylalanine salts, alanine salts, aminobutyrate salts, 2-amino-2-methyl-1,3-propane diol salts, valine salts, proline salts, trishydroxyaminomethane salts, lysine salts. In particular, carbonate salts, phosphate salts, tetraborate salts, and hydroxybenzoate salts are preferred buffer agents because these salts have many advantages including improved solubility, buffering ability in a high pH region of pH 9.0 or higher, no adverse influence (like fog) on photographic performance when added to color developers, and low cost.

Illustrative examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The buffer agent is preferably added to the color developer or color developer replenisher in an amount of at least 0.1 mol/liter, more preferably 0.1 to 0.4 mol/liter.

In the color developer, various chelating agents may be used as an agent for preventing calcium and magnesium from precipitating and for improving the stability of the developer. Exemplary chelating agents include nitrilotriacetic acid, diethylenetriaminepentaacetic acid, ethylenediaminetetraacetic acid, N,N,N-trimethylene-phosphonic acid, ethylenediamine-N,N,N',N'-tetramethylene-phosphonic acid, transcyclohexanediaminetetraacetic acid, 1,2-diaminopropanetetraacetic acid, glycol ether diamine tetraacetic acid, ethylenediamine orthohydroxyphenylacetic acid, 2-phosphonobutane-1,2,4-tricarboxylic acid, 1-hydroxy-ethylidene-1,1-diphosphonic acid, N,N'-bis(2-hydroxybenzyl)-ethylenediamine-N,N'-diacetic acid, and hydroxyethylimino-diacetic acid. These chelating agents may be used alone or in admixture of two or more. The amount of the chelating agent added should be sufficient to block metal ions in the color developer, and is generally 0.1 to 10 grams/liter.

In the color developer, any desired development accelerator is added if necessary. Useful development accelerators include thioether compounds as described in JP-B 16088/1962, 5987/1962, 7826/1963, 12380/1969, 9015/1970, U.S. Pat. No. 3,318,247; p-phenylenediamine compounds as described in JP-A 49829/1977 and 15554/1975; quaternary ammonium salts as described in JP-A 137726/1975, 156826/1982, 43429/1977 and JP-B 30074/1969; amine compounds as described in U.S. Pat. Nos. 2,494,903, 3,128,182, 4,230,796, 3,253,919, 2,482,546, 2,596,926, 3,582,346 and JP-B 11431/1966; polyalkylene oxides as described in JP-B 16088/1962, 25201/1967, 11431/1966, 23883/1967, U.S. Pat. Nos. 3,128,183 and 3,532,501; and 1-phenyl-3-pyrazolidones and imidazoles. Benzyl alcohol is as previously described.

Optionally, any desired antifoggant is added to the developer. Exemplary antifoggants include alkali halides such as sodium chloride, potassium bromide, and potassium iodide, and organic antifoggants as typified by nitrogenous heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, and adenine.

In the practice of the invention, the color developer is preferably adjusted to a chloride ion concentration of $5\times10^{-2}$ to $2\times10^{-1}$ mol/liter, more preferably $6\times10^{-2}$ to $1.5\times^{10-1}$ mol/liter, most preferably $8\times10^{-2}$ to $1.3\times10^{-1}$ mol/liter for preventing a variation of photographic properties. Also, the color developer is preferably adjusted to a bromide ion concentration of $1\times10^{-4}$ to $4\times10^{-4}$ mol/liter, more preferably $1.2\times10^{-4}$ to $3.8\times10^{-4}$ mol/liter, most preferably $1.5\times10^{-4}$ to $3.5\times10^{-4}$ mol/liter for preventing a variation of photographic properties. Most preferably chloride and bromide ions are copresent in the above-defined concentrations.

A fluorescent brightening agent is contained in the color developer and color developer replenisher, if necessary. Preferred brighteners are 4,4'-diamino-2,2'-disulfostilbene compounds. Compounds of the following general formula (SR) are preferred because of their solubility in replenisher solution, improved solubility of slurry processing composition, and reduced stain of processed photosensitive material.

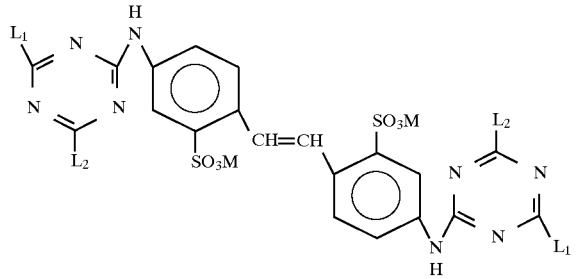

In formula (SR), each of $L_1$ and $L_2$ which may be identical or different is a group $—OR_{11}$ or $—NR_{12}R_{13}$ wherein each of $R_{11}$, $R_{12}$ and $R_{13}$ is a hydrogen atom or alkyl group and satisfies at least one of the following requirements (1) and (2).

(1) Four substituents $L_1$ and $L_2$ in formula (SR) have in total at least 4 substituents selected from the class of the following general formula (A).

(2) Four substituents $L_1$ and $L_2$ in formula (SR) have in total at least 2 substituents selected from the class of the following general formula (A) and at least 2 substituents selected from the class of the following general formula (B).

Class of general formula (A)

$$—SO_3M,\ —OSO_3M,\ —COOM,\ —NR_3X$$

Class of general formula (B)

$$—OH,\ —NH_2,\ —CN,\ —NHCONH_2$$

In the class of formula (A), X is a halogen atom and R is an alkyl group. In formula (SR) or (A), M is a hydrogen atom, alkaline earth metal, ammonium or pyridinium.

The compound of formula (SR) is effective either when used alone or when used in combination with plural types of diaminostilbene compounds. For such combined use, the compound to be combined is preferably a compound of formula (SR) or a diaminostilbene compound of the following general formula (SR-c).

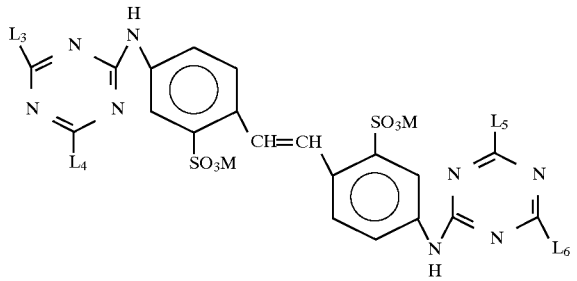

In formula (SR-c), each of $L_3$, $L_4$, $L_5$, and $L_6$ which may be identical or different is a group —$OR_{18}$ or —$NR_{19}R_{20}$ wherein each of $R_{18}$, $R_{19}$ and $R_{20}$ is a hydrogen atom or substituted or unsubstituted alkyl group.

The brightening agent which is used in combination with the compound of formula (SR) may be selected from commercially available diaminostilbene brighteners. Such commercially available compounds are described in "Dyeing Note," 19th Ed., Senshoku-sha, pp. 165–168. Among the products described therein, Whitex RP and Whitex BRF liq. are preferred.

In the practice of the invention, the color developer may be used at a processing temperature of 20° to 50° C., preferably 30° to 45° C. The developing time is 20 seconds to 5 minutes, preferably 30 seconds to 2 minutes.

Next, the desalting procedure which can be applied in the practice of the invention is described.

The desalting procedure is generally a combination of bleaching, fixing and blix steps. Typical procedures are shown below.

(1) bleach-fixation (2) bleach-blix (3) bleach-blix-fixation (4) bleach-washing-fixation (5) blix (6) bleach-blix Procedure (5) is preferred in the practice of the invention.

A processing solution having a bleaching function (used to encompass bleaching and blix solutions) is described below. The processing solution having a bleaching function should contain a bleaching agent, preferably in an amount of 0.01 to 1 mol/liter, more preferably 0.03 to 0.5 mol/liter, most preferably 0.05 to 0.5 mol/liter.

The bleaching agents used in the processing solution having a bleaching function include Fe (III), Co (III) or Mn (III) chelate bleaching agents of the following compounds, persulfates (e.g., peroxodisulfates), hydrogen peroxide, and bromic acid salts.

The compounds which form chelate bleaching agents include ethylenediaminetetraacetic acid, diethylenetriamine-pentaacetic acid, ethylenediamine-N-(β-oxyethyl)-N,N',N'-triacetic acid, 1,2-diaminopropanetetraacetic acid, 1,3-diaminopropanetetraacetic acid, nitrilotriacetic acid, nitrilo-N-2-carboxy-N,N-diacetic acid, N-(2-acetamido)-iminodiacetic acid, cyclohexanediaminetetraacetic acid, iminodiacetic acid, dihydroxyethylglycine, ethyl ether diamine tetraacetic acid, glycol ether diamine tetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, and sodium and ammonium salts thereof. Preferred among these are 1,3-diaminopropanetetraacetic acid, nitrilo-N-2-carboxy-N,N-diacetic acid, N-(2-acetamido)iminodiacetic acid, and ethylenediaminetetraacetic acid.

In the processing solution having a bleaching function, halides such as chlorides, bromides, and iodides are preferably added as a re-halogenating agent for promoting oxidation of silver. Instead of the halides, organic ligands capable of forming difficultly soluble silver salts may be added. The halides are usually added in the form of alkali metal salts, ammonium salts, or salts with guanidine or amines. Exemplary halides are potassium bromide, sodium bromide, ammonium bromide, potassium chloride, and guanidine hydrochloride, with the potassium bromide and sodium bromide being preferred. The re-halogenating agent is usually added to the bleaching solution in an amount of up to 2 mol/liter, preferably 0.01 to 2.0 mol/liter, more preferably 0.1 to 1.7 mol/liter.

The bleach-fix solution contains a fixing agent to be described later and other compounds commonly contained in the fixer as will be described later. If desired, the bleach-fix solution contains a re-halogenating agent as described above. When added to the bleach-fixing solution, the re-halogenating agent is usually used in an amount of 0.001 to 2.0 mol/liter, preferably 0.001 to 1.0 mol/liter.

To the bleaching or bleach-fix solution, bleach promoters, anti-corrosion agents for preventing corrosion of a processing tank, buffer agents for maintaining the bath at appropriate pH, fluorescent brighteners, defoaming agents and the like are added if necessary. The bleach promoters used herein include compounds having a mercapto or disulfide group as disclosed in U.S. Pat. Nos. 3,893,858 and 1,138,842, German Patent No 1,290,812, JP-A 95630/1978, and Research Disclosure, No. 17129 (1978), thiazolidine derivatives as described in JP-A 140129/1975, thiourea derivatives as described in U.S. Pat. No. 3,706,561, polyethylene oxides as described in German Patent No. 2,748,430, polyamines as described in JP-B 8836/1970, and imidazole compounds as described in JP-A 40493/1974. Preferred among others are the mercapto compounds described in U.S. Pat. No. 1,138,842. The anti-corrosion agents include nitrates such as ammonium nitrate, sodium nitrate and potassium nitrate. The anti-corrosion agents are added in amounts of 0.01 to 2.0 mol/liter, preferably 0.05 to 0.5 mol/liter. In the bleaching or bleach-fix solution according to the invention, the total concentration of ammonium ion should preferably be less than 0.3 gram-ion/liter. This embodiment is preferred for image storage and environmental protection. A concentration of less than 0.1 mol/liter is more preferred.

The bleaching or bleach-fix solution according to the invention is adjusted to pH 2.0 to 8.0, preferably pH 3.0 to 7.5. When bleaching or bleach-fixation immediately follows color development, the solution is preferably used at pH 7.0 or lower, more preferably pH 6.4 or lower in order to suppress bleaching fog. Especially, the bleaching solution is used at pH 3.0 to 5.0. At pH 2.0 or lower, metal chelates become unstable. Therefore, the pH range of 2.0 to 6.4 is preferred.

The pH buffer agent used to this end may be any one of agents which are unsusceptible to oxidation by the bleaching agent and exert buffering action in the above-defined pH range. Examples include organic acids such as acetic acid, glycolic acid, lactic acid, propionic acid, butyric acid, malic acid, chloroacetic acid, levulinic acid, ureido-propionic acid, oxalic acid, malonic acid, succinic acid, glutaric acid, maleic acid, fumaric acid, citraconic acid, itaconic acid, β-hydroxypropionic acid, tartaric acid, citric acid, oxalacetic acid, diglycolic acid, benzoic acid, and phthalic acid; and organic bases such as pyridine, dimethylpyrazole, 2-methyl-o-oxazoline and aminoaceto-nitrile. These buffer agents may be used alone or in admixture of two or more. Organic acids having pKa 2.0 to 5.5 are preferred, with acetic acid and glycolic acid either alone or in admixture being especially preferred. The buffer agents are used in a total amount of less than 3.0 mol/liter, preferably 0.1 to 2.0 mol/liter. To adjust the pH of the processing solution having a bleaching function to the above-defined range, the above-mentioned acid may be used in combination with an alkaline agent such as aqueous ammonia, KOH, NaOH, imidazoles, monoethanolamine, and diethanolamine. KOH is especially preferred.

The bleaching or bleach-fixation step is usually carried out at a temperature of 30° to 60° C., preferably 35° to 50° C. The time of bleaching or bleach-fixation step is usually 10 seconds to 2 minutes, preferably 10 seconds to 1 minute, more preferably 15 to 45 seconds. Under such preferred conditions, rapid processing is possible with good results of no stain increase.

Well-known fixing agents are used in the bleach-fix or fixing solution. The fixing agents include thiosulfates, thiocyanates, thioethers, amines, mercaptos, thiones, thioureas, iodides, and meso-ionics, more illustratively, ammonium thiosulfate, sodium thiosulfate, potassium thiosulfate, guanidine thiosulfate, potassium thiocyanate, dihydroxyethyl thio ether, 3,6-diathi-1,8-octane diol, and imidazoles. Thiosulfates, especially ammonium thiosulfate are preferred for rapid fixation. Further rapid fixation is possible with the use of two or more fixing agents combined. For example, ammonium thiosulfate is combined with ammonium thiocyanate, imidazole, thiourea or thioether while the second fixing agent is preferably added in an amount of 0.01 to 100 mol % of the ammonium thiosulfate. The amount of the fixing agent used is usually 0.1 to 3.0 mol, preferably 0.5 to 2.0 mol per liter of the bleach-fix or fixing solution. The fixing solution is generally at pH 3.0 to 9.0 although the pH varies with the type of fixing agent. Particularly when thiosulfates are used, pH 6.5 to 8.0 is preferred for stable performance.

To the bleach-fix or fixing solution, a preservative may be added for enhancing the stability of the solution with the lapse of time. In the case of bleach-fix or fixing solution containing a thiosulfate, the preservative is preferably selected from sulfites and bisulfite addition compounds of hydroxylamines, hydrazines and aldehydes (for example, bisulfite addition compounds of acetoaldehydes, especially bisulfite addition compounds of aromatic aldehydes as described in JP-A 298935/1989). Sulfinic acid derivatives as described in JP-A 143048/1987 are also useful.

Also preferably, a buffer agent is added to the bleach-fix or fixing solution for maintaining the pH of the solution constant. Useful buffer agents include phosphates, imidazoles such as 1-methyl-imidazole, 2-methyl-imidazole, and 1-ethyl-imidazole, triethanolamine, N-allylmorpholine, and N-benzoylpiperazine.

In the fixer, various chelating agents may be added for improving the stability of the solution by masking iron ions carried over from the bleaching solution. Useful chelating agents include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid, and 1,2-propanediaminetetraacetic acid.

The fixing step is usually carried out at a temperature of 30° to 60° C., preferably 35° to 50° C. The time of fixing step is usually 5 seconds to 2 minutes, preferably 10 seconds to 1 minute 40 seconds, more preferably 10 to 45 seconds.

With respect to replenishment, the bleaching solution is usually replenished in an amount of 20 to 900 ml, preferably 20 to 550 ml, more preferably 30 to 250 ml per square meter of photosensitive material. The bleach-fix solution is usually replenished in an amount of 20 to 1500 ml, preferably 30 to 600 ml, more preferably 30 to 200 ml per square meter of photosensitive material. The bleach-fix solution may be made up by supplying a bleach-fix solution or by separately supplying a bleaching composition and a fixing composition. Alternatively, a bleach-fixer replenisher may be obtained by mixing an overflow from the bleaching bath and/or fixing bath. The fixing solution is usually replenished in an amount of 20 to 1500 ml, preferably 30 to 600 ml, more preferably 30 to 200 ml per square meter of photosensitive material. By channeling an overflow from the washing or stabilizing step to a precedent bath having a fixing function, the amount of waste solution can be reduced.

The processing step having a fixing function is generally followed by a water washing step. Also employable is a simple process of carrying out stabilizing treatment with a stabilizing solution after processing with a processing solution having a fixing function without substantial water washing.

In the water washing or stabilizing step, the washing or stabilizing solution is replenished in an amount of 3 to 50 times, preferably 3 to 30 times, more preferably 3 to 10 times the carry-over from the precedent bath per unit area of photosensitive material. When water washing is followed by stabilizing treatment, the stabilizing step as the final step is preferably such that the replenishment is 3 to 50 times the carry-over from the precedent bath. Replenishment may be done continuously or intermittently. The solution used in the water washing and/or stabilizing step may be further used in the precedent step. In one embodiment, a multi-stage counter-current system is used for water washing for saving washing water, an overflow of washing water is channeled to the precedent bath, that is, bleach-fix bath, and a concentrate is replenished to the bleach-fix bath. This embodiment is successful in eventually reducing the amount of waste solution.

In the water washing step, the amount of washing water supplied may be selected in a wide range in accordance with the properties and application of photosensitive material (e.g., couplers and other components used therein), temperature of washing water, the number of washing tanks or stages, and make-up system which is either counter-current or forward. In the multi-stage counter-current system, the number of stages is generally 2 to 6, preferably 2 to 4.

The multi-stage counter-current system is effective for reducing the amount of washing water and enables to supply 0.5 to 1 liter of water per square meter of photosensitive material, for example. However, since water remains in the tank for a longer time, there arise problems of bacteria growth and formation of floating matter which can attach to the photosensitive material. One solution to these problems is to reduce calcium and magnesium in water as described in JP-A 288838/1987. It is also preferable to use water sterilized with halogens, UV sterilizing lamps, or ozone generators.

In the washing water and stabilizing solution, various anti-bacterial agents and anti-fungal agents are preferably contained for preventing slime formation and mold from growing in processed photosensitive material. Exemplary anti-bacterial agents and anti-fungal agents include thiazolylbenzimidazole compounds as disclosed in JP-A 157244/

1982 and 105145/1983, isothiazolone compounds as disclosed in JP-A 8542/1982, chlorophenols as typified by trichlorophenol, bromophenols, organic tin compounds, organic zinc compounds, acid amide compounds, diazine and triazine compounds, thiourea compounds, benzotriazoles, alkylguanidines, quaternary ammonium salts as typified by benzalkonium chloride, and antibiotics as typified by penicillin, as well as antibacterial agents as described in J. Antibact. Antifung. Agents, Vol. 1, No. 5, pp. 207–223 (1983), HORIGUCHI Hiroshi, "Bokin Bobai no Kagaku (Antibacterial and Antifungal Chemistry)", Sankyo Publishing K.K., 1982, Eisei-Gijutsu-kai Ed., "Microorganisms Sterilizing, Bactericidal, Antifungal Technology," Kyogyo-Gijutsu-kai, 1982, and Nippon Bokin Bobai Society Ed., "Bokin Bobai-zai Jiten (Glossary of Antibacterial & Antifungal Agents)," 1986. These agents may be used alone or in admixture of two or more. Bactericides as described in JP-A 83820/1973 are also useful.

In the washing water and stabilizing solution, various surfactants are preferably contained in order to prevent water droplets from leaving marks on photosensitive material upon drying. Exemplary surfactants include polyethylene glycol type nonionic surfactants, polyhydric alcohol type nonionic surfactants, alkylbenzenesulfonate type anionic surfactants, higher alcohol sulfate ester salt type anionic surfactants, alkyl naphthalene sulfonate salt type anionic surfactants, quaternary ammonium salt type cationic surfactants, amine salt type cationic surfactants, amino salt type ampholytic surfactants, and betaine type ampholytic surfactants, with the nonionic surfactants being preferred. Alkylphenol ethylene oxide addition products are especially preferred wherein alkylphenols are preferably octyl, nonyl, dodecyl and dinonylphenols and the molar number of ethylene oxide added is preferably 8 to 14. Silicone type surfactants are also useful because of high defoaming ability.

In the washing water and stabilizing solution, various chelating agents are preferably contained. Preferred chelating agents include aminopolycarboxylic acids such as ethylenediaminetetraacetic acid and diethylenetriaminepentaacetic acid; organic phosphonic acids such as 1-hydroxyethylidene-1,1-diphosphonic acid, ethylenediamine-tetraacetic acid, and diethylenetriamine-N,N,N',N'-tetra-methylenephosphonic acid; and hydrolyzates of maleic anhydride polymers as described in EP 345172 A1.

In the stabilizing solution, compounds for stabilizing dye images are contained, for example, formalin, hexamethylenetetramine and derivatives thereof, hexahydrotriazine and derivatives thereof, N-methylol compounds such as dimethylolurea and N-methylolpyrazole, organic acids, and pH buffers. These compounds are preferably added in an amount of 0.001 to 0.02 mol per liter of the stabilizing solution. The concentration of free formaldehyde in the stabilizing solution should preferably be as low as possible because evaporation of formaldehyde gas is minimized. From such a standpoint, the dye image stabilizing agent is preferably selected from hexamethylenetetramine, N-methylolazoles such as N-methylolpyrazole as described in Japanese Patent Application No. 318644/1991, and azolyl-methylamines such as N,N'-bis(1,2,4-triazol-1-yl) piperazine as described in Japanese Patent Application No. 142708/1991. If necessary, there may be contained ammonium compounds such as ammonium chloride and ammonium sulfite, metal compounds such as compounds of Bi and Al, fluorescent brighteners, hardeners, alkanolamines as described in U.S. Pat. No. 4,786,583, and preservatives as contained in the fixing and bleach-fix solutions. Preferred among others are sulfinic acid compounds (e.g., benzenesulfinic acid, toluenesulfinic acid, and sodium and potassium salts thereof) as described in JP-A 231051/1989. They are preferably added in an amount of $1\times10^{-5}$ to $1\times10^{-3}$ mol, especially $2\times10^{-5}$ to $5\times10^{-4}$ mol per liter of the stabilizing solution.

In the water washing and stabilizing steps, water or stabilizing solution is usually made up in an amount of 50 to 2,000 ml, preferably 100 to 1,000 ml per square meter of photosensitive material. One effective means for reducing the replenishment amount without detracting from the stability of dye images is reverse osmosis treatment using a reverse osmosis membrane as disclosed in JP-A 121448/1991. The washing water and stabilizing solution are generally used at pH 4 to 10, preferably pH 6 to 9. The processing temperature is preferably 30° to 45° C. and the processing time is generally 10 seconds to 2 minutes, preferably 10 to 60 seconds.

For environmental protection, the amount of replenisher solution is preferably reduced by the above-mentioned means. further reduction is expectable by combining various regenerating methods. Regeneration of the processing solution can be carried out while circulating the solution in the automatic processor. Alternatively, the processing solution is once taken out of the processing tank, regenerated by suitable treatment, and then fed back to the processing tank. In particular, the developer can be regenerated for reuse. The used developer is regenerated by passing it through an anion exchange resin, effecting electric dialysis, or by adding a chemical composition known as a regenerating agent to it to increase its activity whereupon the solution is ready for reuse. The percent regeneration (which is given as the proportion of an overflow in overall replenisher solution) is preferably at least 50%, more preferably at least 70%.

In a process involving regeneration of a developer, an overflow of the developer is regenerated and used as a replenisher. The means for regeneration is preferably an anion exchange resin. Regarding the preferred composition of anion exchange resin and the regeneration of the resin itself, reference is made to Diaion Manual (I), 14th Ed. (1986) by Mitsubishi Chemical K.K. Preferred anion exchange resins are those of the composition described in JP-A 952/1990 and 281152/1989. It is also recommended that an overflow is regenerated as a replenisher merely by adding a regenerating agent thereto without resorting to anion exchange or electric dialysis as in the method described in JP-A 174154/1991 because this method is quite simple.

The bleaching and bleach-fix solutions are preferably generated by a continuous method cooperating with the bleaching step because the metal chelate bleaching agent contained therein is reduced upon bleaching. More particularly, aeration is preferably carried out by using an air pump to blow air into the bleaching and bleach-fix solutions, thereby re-oxidizing the metal chelate in reduced state with oxygen. Alternatively, the bleaching and bleach-fix solution can be regenerated by adding oxidizing agents such as hydrogen peroxide, persulfate salts, and bromic acid salts.

The fixing and bleach-fix solutions are regenerated by electrolytic reduction of accumulating silver ions. Removal of accumulating halide ions by an anion exchange resin is also preferred for maintaining a fixing function. It is also recommended that an overflow of the bleach-fix solution is regenerated as a replenisher merely by adding a regenerating agent thereto without resorting to aeration or anion exchange to remove silver ions as in the method described in EP 479262 A1 because this method is quite simple.

From the processing solution having a fixing function, silver recovery can be done by well-known methods. The solution regenerated by silver recovery can be reused. Silver recovery can be done by electrolysis as described in French Patent No. 2,299,667, precipitation as described in JP-A 73037/1977 and German Patent No. 2,331,220, ion exchange as described in JP-A 17114/1976 and German Patent No. 2,548,237, and metal substitution as described in UKP 1,353,805. Silver recovery from the tank solution is preferably carried out in line because rapid process adaptability is improved.

For the processing of photographic black-and-white silver halide photosensitive material (sometimes simply referred to as black-and-white photosensitive material), developer, fixer, wash water and stabilizing solution are generally used. For the detail of the processing solutions and conditions, reference is made to JP-A 136043/1988, 165161/1993, 13306/1995, and 77781/1995, for example.

The processing composition to which the invention is applicable may be supplied as a single part or plural parts of concentrate, preferably a single part of concentrate. A combination of a concentrate with a powder or a ready-to-use solution is also acceptable.

The processing composition is generally contained in a replenishing cartridge which may be made of any desired material such as paper, plastics and metals, preferably plastic materials having a coefficient of oxygen permeation of up to 50 ml/m$^2$.atm.day. The coefficient of oxygen permeation is measured by the method described in N. J. Calyan, "$O_2$ permeation of plastic container," Modern Packing, December 1968, pp. 143–145. Preferred plastic materials include polyvinylidene chloride (PVDC), nylon (NY), polyethylene (PE), polypropylene (PP), polyester (PES), ethylene-vinyl acetate copolymers (EVA), ethylene-vinyl alcohol copolymers (EVAL), polyacrylonitrile (PAN), polyvinyl alcohol (PVA), and polyethylene terephthalate (PET). Among these, PVDC, NY, PE, EVA, EVAL, and PET are preferred for the purpose of reducing oxygen permeability.

These materials may be used alone and shaped into containers. Alternatively, they are shaped into films which are laminated in a proper combination (into a so called laminate or composite film). The container may take any desired shape including bottle, cubic and pillow shapes. Cubic type and analogous containers are preferred because they are flexible, easy to handle; and collapsible into a minimal volume after use. The composite film should preferably have the following structure although not limited thereto. The components of composite film are described in the order from the outside to the inside (in contact with contents).

PE/EVAL/PE
PE/aluminum foil/PE
NY/PE/NY
NY/PE/EVAL
PE/NY/PE/EVAL/PE
PE/NY/PE/PE/PE/NY/PE
PE/$SiO_2$ film/PE
PE/PVDC/PE
PE/NY/aluminum foil/PE
PE/PP/aluminum foil/PE
NY/PE/PVDC/NY
NY/EVAL/PE/EVAL/NY
NY/PE/EVAL/NY
NY/PE/PVDC/NY/EVAL/PE
PP/EVAL/PE
PP/EVAL/PP
NY/EVAL/PE
NY/aluminum foil/PE
paper/aluminum foil/PE
paper/PE/aluminum foil/PE
PE/PVDC/NY/PE
NY/PE/aluminum foil/PE
PET/EVAL/PE
PET/aluminum foil/PE
PET/aluminum foil/PET/PE The composite film preferably has a gage of about 5 to 1,500 $\mu$m, more preferably about 10 to 1,000 $\mu$m. The container should preferably have an interior volume of about 100 ml to 20 liters, more preferably about 500 ml to 10 liters.

The container or cartridge may be received in an outer box of corrugated paper board or plastic material. Alternatively, the container or cartridge is integrally formed with an outer box.

Cartridges are filled with various processing solutions, for example, color developer, black-and-white developer, bleaching solution, compensating solution, reversal solution, fixing solution, bleach-fix solution, and stabilizing solution. Particularly for the color developer, black-and-white developer, fixing solution and bleach-fix solution, cartridges with a low coefficient of oxygen permeation are appropriate.

Also useful are containers for conventional processing solutions, for example, rigid containers of a single layer stock such as high density polyethylene (HDPE), polyvinyl chloride resin (PVC), and polyethylene terephthalate (PET) and a multi-layer stock such as nylon/polyethylene (NY/PE). Also useful are flexible containers for liquid because they can be reduced in volume or require a minimal space after they are emptied of the liquid.

The container preferably has a cap or inner plug made of the same material as the container body because classification of used containers for recycle use becomes easy. Like the container body, the cap is given necessary gas barrier property by choosing a suitable stock material. Although the interior volume of the container is not critical, a volume of about 50 ml to about 5 liters is convenient to handle.

The container can be recycled for reuse by the following exemplary sequence. (1) The user collapses a bellows portion of a used container under pressure, tightens the inner plug and cap again, and stores the collapsed container. (2) When a considerable number of used containers accumulated at the user site, they are collected from the user. (3) The used containers with caps on are fed into a shredder whereby they are shred into fragments. (4) The fragments are admitted in a water tank, washed for a certain time, and dried. The fragments are ready for use as a stock material for molding resinous articles. (5) The regenerated material is admixed with a virgin stock material to form a compound, from which containers are molded. The containers are filled with a fresh processing composition and marketed.

By suitably choosing a stock material or changing the properties thereof, the liquid container can be given necessary gas barrier property. Where high oxygen barrier property is required as in the containment of developer, the container is formed of a multi-layer structure based on low density polyethylene such as a three-layer structure of low density polyethylene/ethylene-vinyl alcohol copolymer/low density polyethylene (LDPE/EVOH/LDPE) and a two-layer structure of low density polyethylene/nylon (LDPE/NY) such that the container may have gas barrier property as expressed by a coefficient of oxygen permeation of up to 25 ml/m$^2$.atm.day at 20° C. and RH 65%, more preferably 0.5 to 10 ml/m$^2$.atm.day at 20° C. and RH 65%. Where high oxygen barrier property is not necessarily required as in the containment of bleaching solution, the container may be formed of low density polyethylene (LDPE) or ethylene-vinyl alcohol copolymer (EVA) alone. The low density polyethylene used herein has a density of up to 0.940 g/cc, preferably 0.90 to 01.94 g/cc, more preferably 0.905 to 0.925 g/cc. Then there is achieved gas barrier property as expressed by a coefficient of oxygen permeation of more than 50 ml/m$^2$.atm.day at 20° C. and RH 65%, more preferably 100 to 5000 ml/m$^2$.atm.day at 20° C. and RH 65%.

Preferably the container is formed to an average wall thickness of 0.1 to 1.5 mm, more preferably 0.2 to 1.0 mm, most preferably 0.3 to 0.7 mm at its body and to an average wall thickness of 1 to 4 mm, more preferably 1 to 3 mm, most preferably 1.2 to 2.5 mm at and near its mouth and flange. The difference in wall thickness between the body and the mouth is preferably at least 0.2 mm, more preferably about 0.5 mm.

The surface area (cm$^2$) of a container divided by the interior volume (cm$^3$) is preferably 0.3 to 1.5 cm$^{-1}$, more preferably 0.4 to 1.2 cm$^{-1}$, most preferably 0.5 to 1.0 cm$^{-1}$.

When the container is filled with a liquid, it is preferred for improving the stability of the liquid that the head space (that is, the empty space at the top of the container) is as small as possible. The percent fill of the container with liquid is preferably 65 to 100%, more preferably 90 to 100%, most preferably 100%.

Photosensitive material is generally processed using an automatic processor. Examples of the color photosensitive material which can be processed with the composition of the invention include color negative film, color negative paper, color reversal paper, auto-positive paper, color reversal film, motion picture negative film, and motion picture positive film. The black-and-white photosensitive materials which can be processed with the composition of the invention are general black-and-white photosensitive materials including photographic materials adapted for laser light sources, printing photosensitive materials, medical direct radiographic x-ray-sensitive materials, medical fluorographic x-ray-sensitive materials, CRT image-recording photosensitive materials, microfilm, and ordinary picture-taking photosensitive materials.

With respect to the silver halide emulsion, other components (including additives), and photographic layers (including a layer arrangement) of the photosensitive material to which the invention is applicable as well as a method for processing the photosensitive material and additives used in processing solutions, reference is made to the following patent publications, especially EP 0,355,660 A2 or Japanese Patent Application No. 107011/1989.

| Photographic element | JP-A 215272/1987 | JP-A 33144/1990 | EP 0,355,660 A2 |
|---|---|---|---|
| Silver halide emulsion | p.10, right-upper col., line 6 p.12, left-lower col., line 5 p. 12, right-lower col., line 4 from bottom - p.13, left-upper col., line 17 | p.28, right-upper col., line 16 - p. 29, right-lower col., line if p.30, lines 2 to 5 | p. 45, lines 53 - p. 47, line 3 p. 47, lines 20 to 22 |
| Silver halide solvent | p.12, left-lower col., lines 6 - 14 p.13, Left-upper col., line 3 from bottom - p.18, left-lower col., last line | | |
| Chemical sensitizer | p.12, left-lower col., line 3 from bottom - right-lower col., line 5 from bottom p.18, right-lower col., line 1 - p. 22, right-upper col., line 9 from bottom | p. 29, right-lower col., line 12 - the last line of the column | p.47, lines 4 to 9 |
| Spectral sensitize (spectra sensitization method) | p. 22, right-upper col., line 8 from bottom- p. 38, last line | p.30, left-upper col., lines 1 - 13 | p. 47, lines 10 - 15 |
| Emulsion stabilizer | p. 39, left- upper col., line 1 - p. 72, right-upper col., last line | p. 30, left- upper col., line 14 - right-upper col., line 1 | p. 47, lines 16 - 19 |
| Development accelerator | p. 72, left-lower col., line 1 - p. 91, right-upper col., line 3 | | |
| Color coupler (cyan, magenta, yellow couplers) | p. 91, right-upper col., line 4 - p. 121, left-upper col., line 6 | p. 3, right-upper col., line 14 - p. 18, left-upper col., last line p. 30; right-upper col., line 6 - p. 35, right-lower col., line 11 | p.4, lines 15 - 27 p.5, line 30 - p.28 last line p. 45, lines 29 - 31 p. 47, line 23 -p. 63, line 50 |
| Color development enhancer | p. 121, left-upper col., line 7 - p. 125, right-upper col., line 1 | | |
| UV absorber | p. 125, right-upper col.; line 2 - p. 127, left-lower col., last line | p. 37, right-lower col., line 14 - p. 38, left-upper col., line 11 | p. 65, lines 22 to 31 |
| Anti-fading agent | p. 127, right-lower | p. 36, right-upper col., | p. 4, line 30 - p. 5, |

-continued

| Photographic element | JP-A 215272/1987 | JP-A 33144/1990 | EP 0,355,660 A2 |
|---|---|---|---|
| (image stabilizing agent) | col., line 1 - p. 137, left-lower col., line 8 | line 12 - p.37, left-upper col., Line 19 | line 23<br>p.29, line 1 - p. 45, line 25<br>p.45, lines 33–40<br>p.65, lines 2–21 |
| High- and/or low-melting organic solvent | p. 137, left-lower col., line 9 - p. 144, right-upper col., last line | p. 35, right-lower col., line 14 - p.36, left-upper col., line 4 from bottom | p. 64, lines 1–51 |
| Dispersion of photographic additive | p. 144, left-lower col., line 1 - p. 146, right-upper col., line 7 | p. 27, right-lower col., line 10 - p.28, left-upper col., last line<br>p.35, right-lower col., line 12 - p.36, right-upper col., line 7 | p. 63, line 51 - p. 64, Line 56 |
| Anti-staining agent | p. 188, right-lower col., line 9 - p. 193, right-lower col., line 10 | p. 37, left-upper col., last line - right-upper col., line 13 | p. 65, line 32 - p. 66, line 17 |
| Surfactant | p. 201, left-lower col., line 1 - p. 210, right-upper col., last line | p. 18, right-upper col., line 1 - p. 24, right-lower col., last line<br>p. 27, left-lower col., line 10 from bottom - right-lower col., line 9 | |
| Fluorinated compound (as antistatic agent, coating aids, lubricant and anti-adhesion agent) | p. 210, left-lower col., line 1 - p. 222, left-lower col., line 5 | p. 25, left-upper col., line 1 - p. 27, right-upper col., line 9 | |
| Binder (hydrophilic colioid) | p.222, left-lower col., line 6 - p. 225, left-upper col., last line | p. 38, right-upper col., lines 8–18 | p. 66, lines 23–28 |
| Thickener | p. 225, right-upper col., line 1 - p. 227, right-upper col., line 2 | | |
| Antistatic agent | p. 227, right-upper col., line 3 - p. 230, left-upper col., line 1 | | |
| Hardener | p. 146, right-upper col., line 8 - p. 155, left-lower col., line 4 | | |
| Developer precursor | p. 155, left-lower col., line 5 - p. 155, right-lower col.; line 2 | | |
| Development restrainer-releasing compound | p. 155, right-lower col., lines 3 - | | |
| Support | p. 155, right-lower col., line 19- p. 156, left-upper col., line 14 | p.38, right-upper col., line 18 - p. 39, left-upper col., line 3, | p. 66, line 29 - p. 67, line 13 |
| Photosensitive layer arrangement | p. 156, left-upper col., line 15 - right-lower col., line 14 | p. 28, right-upper col., lines 1–15 | p. 45, lines 41–52 |
| Dye | p. 156, right-lower col., line 15 - p. 184, right-lower col., last line | p.38, left-upper col., line 12 - right-upper col., line 7 | p. 66, lines 18–22 |
| Color mix preventing agent | p. 185, left-upper col., line 1 - p. 188, right-lower col., line 3 | p. 36, right-upper col., lines 8–11 | p. 64, line 57 - p. 65, line 1 |
| Gradation regulating agent | p. 188, right-lower col., lines 4–8 | | |
| Polymer latex | p. 230, left-upper col., line 2 - p. 239, last line | | |
| Matte agent | p. 240, left-upper col., line 1 - right-upper col., | | |

-continued

| Photographic element | JP-A 215272/1987 | JP-A 33144/1990 | EP 0,355,660 A2 |
|---|---|---|---|
| | last line | | |
| Photographic process (processing steps and additives | p. 3, right-upper col., line 7 - p. 10, right-upper col., line 5 | p. 39, left-upper col., line 4 - p. 42, left-upper col., last line | p. 67, line 14 - p. 69, line 28 |

Note that JP-A 215272/1987 contains the Amendment dated March 16, 1987.
Among the color couplers, the yellow couplers include short wave type yellow couplers as described in JP-A231451/1988, 123047/1988, 241547/1988, 173499/1989, 213648/1989, and 250944/1989.

EXAMPLE

Examples of the present invention are given below by way of illustration and not by way of limitation.

Example 1

A concentrate of color development replenisher for color paper was prepared. On use, the concentrate was diluted by a factor of 5 into a ready-to-use solution. The formulation of the concentrate per 5 liters of ready-to-use solution is shown below.

| Concentrate of color development replenisher | |
|---|---|
| Cation-exchanged water | 600 ml |
| Dimethylpolysiloxane surfactant (Silicone KF351A by Shin-Etsu Chemical K.K.) | 0.5 g |
| Triisopropanolamine | 50 g |
| EDTA | 20 g |
| Sodium 4,5-dihydroxybenzene-1,3-disulfonate | 2.5 g |
| Sodium sulfite | 0.5 g |
| Brightener (Hakkol FWA-SF by Showa Chemical K.K.) | 10 g |
| Disodium N,N-bis(sulfonatoethyl)hydroxylamine | 60 g |
| N-ethyl-N-(β-methanesultonamidoethyl)-3-methyl-4-amino-4-aminoaniline 3/2 hydrogen sulfate monohydrate | 80 g |
| Potassium carbonate | 130 g |
| Sodium hydroxide | 10 g |
| Water-soluble polymer | (see Table 1) |
| Cation-exchanged water | totaling to 1000 ml |

There were prepared processing composition sample Nos. 1 to 10 having a water-soluble polymer added thereto and sample No. 11 free of a water-soluble polymer. These samples were examined by the following tests.

Tests

1) Brookfield viscosity

A composition sample and a 1 wt % aqueous solution of a water-soluble polymer used therein were measured for viscosity at 25° C. and a low shear rate by a Brookfield viscometer.

2) Discharge from container

A composition sample was contained in a 1-liter rectangular plastic bottle at 50° C. The bottle was turned upside down and allowed to stand for 5 minutes. The weight of the composition sample which was left attached to the inner wall of the bottle was measured.

3) Anti-separation stability after storage

A composition sample was contained in a 1-liter rectangular plastic bottle, which was shelf stored for one month at 5° C. The sample was visually observed to examine whether or not solid matter sedimented and separated from the liquid. The volume of uniformly dispersed solids divided by the sample volume is designated a solids fraction (%). The solids fraction is 100% when the slurry is kept uniformly dispersed without sedimentation, and a less solids fraction indicates more sedimentation and separation. The sample was also examined for anti-separation stability immediately after preparation.

4) Discharge from container after storage

The sample was stored as in 3) before it was tested as in 2). The weight of the sample which was left attached to the bottle wall was measured.

5) Solubility

The sample was admitted into a 5-liter dissolving tank which had been charged with water at 20° C. in such an amount that 5 liters of ready-to-use solution might be obtained after dissolution and dilution. The tank contents were agitated by an agitating blade to measure the time taken until the sample was dissolved.

6) Influence on photographic properties

A color development replenisher was prepared by diluting the sample to 5 liters and completely dissolving in the same manner as in 5). A coated sample A was prepared as a photosensitive material to be evaluated for photographic properties.

Coated sample A was exposed by means of a sensitometer (model FWH by Fuji Photo Film Co., Ltd., light source color temperature 3200K) through a continuous wedge (exposure dose 250 CMS, exposure time 0.1 sec.) and processed by the following steps with the following solutions. The processor used was a mini-labo paper printer processor model PP720WR by Fuji Photo Film Co., Ltd. At the end of processing, the image was measured for maximum density of cyan, magenta and yellow using a Macbeth densitometer. The maximum density is expressed in percent relative to a maximum density of 100% for the water-soluble polymer-free sample.

| Processing step | Temperature | Time |
|---|---|---|
| Color development | 38.5° C. | 45 sec. |
| Bleach fix | 38.0° C. | 45 sec. |
| Rinse (1) | 38.0° C. | 20 sec. |
| Rinse (2) | 38.0° C. | 20 sec. |
| Rinse (3) | 38.0° C. | 20 sec. |
| Rinse (4) | 38.0° C. | 20 sec. |

Rinsing used a 4-tank counter-current system from (4) to (1).

The processing solutions had the following composition (per liter of ready-to-use solution)

| Color developer | |
|---|---|
| Water | 500 ml |
| Color developer replenisiier | 300 ml |
| Potassium chloride | 10 g |
| Sodium bromide | 0.03 g |

-continued

| | | |
|---|---|---|
| Potassium carbonate | 16 | g |
| Water | totaling to 1,000 | ml |
| pH | 10.15 | |
| (at 25° C., adjusted with KOH or sulfuric acid) | | |
| Bleach-fix solution (tank solution) | | |
| Water | 700 | ml |
| Ammonium thiosulfate (750 g/l) | 100 | ml |
| Ammonium sulfite | 35.0 | g |
| Ammonium ferric EDTA | 43.0 | g |
| m-carboxybenzenesulfinic acid | 0.2 | mol |
| Imidazole | 7.7 | g |
| Water | totaling to 1,000 | ml |
| pH | 7.00 | |
| (at 25° C., adjusted with nitric acid or aqueous ammonia) | | |
| Rinse(common to tank and replenisher solutions) | | |
| Sodium chlorinated isocyanurate | 0.02 | g |
| Deionized water (conductivity < 5 μs/cm) | 1000 | ml |
| pH | 6.5 | |

Coated sample A was prepared by the following procedure.

Preparation of Support

A low density polyethylene with MRF=3 was admixed with 30% by weight of titanium dioxide and 3.0% by weight of the titanium dioxide of zinc stearate and milled in a Banbury mixer together with ultramarine (DV-1 by Daiichi Kasei Kogyo K.K.) to be ready for melt extrusion. Note that titanium dioxide had a particle size of 0.15 to 0.35 μm as measured under an electron microscope and was coated with hydrated aluminum oxide in an amount of 0.75% by weight of $Al_2O_3$ based on the weight of the titanium dioxide.

A paper substrate having a basis weight of 170 g/m$^2$ was subject to corona discharge treatment at 10 kVA. Using a multi-layer extrusion coating die, the above-prepared polyethylene composition containing 30 wt % titanium dioxide, a similarly prepared polyethylene composition containing 18 wt % titanium dioxide, and polyethylene free of titanium dioxide, but containing ultramarine were melt extruded at 320° C. on the paper substrate. There was formed a polyethylene laminate layer consisting of an upper stratum of 2 μm thick (titanium dioxide 18 wt %), an intermediate stratum of 21 μm thick (titanium dioxide 30 wt %), and a lower stratum of 10 μm thick (titanium dioxide 0%) adjoining the substrate. The polyethylene laminate layer on its surface was subject to glow discharge treatment.

Preparation of coated sample A

A multilayer color print paper was prepared by coating various photographic layers on the reflective support according to the following layer arrangement. The coating solutions were prepared as follows.

Preparation of third layer coating solution

In 32.5 grams of solvent (Solv-3), 97.5 grams of solvent (Solv-4), 65.0 grams of solvent (Solv-4), and 110 cc of ethyl acetate were dissolved 40.0 grams of magenta coupler (ExM), 40.0 grams of UV absorber (UV-2), 7.5 grams of color image stabilizer (Cpd-2), 25.0 grams of color image stabilizer (Cpd-5), 2.5 grams of color image stabilizer (Cpd-6), 20.0 grams of color image stabilizer (Cpd-7), 2.5 grams of color image stabilizer (Cpd-8), and 5.0 grams of color image stabilizer (Cpd-10). This solution was emulsion dispersed in 1500 grams of a 7% gelatin aqueous solution containing 90 cc of 10% sodium dodecylbenzenesulfonate, obtaining an emulsified dispersion A-1.

There was prepared a silver chlorobromide emulsion B-1 (cubic, a 1:3 (silver molar ratio) mixture of a large size emulsion with a mean grain size of 0.55 μm and a small size emulsion with a mean grain size of 0.39 μm which had a coefficient of variation of grain size distribution of 0.08 and 0.06, respectively, were based on grains of silver chloride having 0.8 mol % of silver bromide locally contained in the grain surface, and contained 0.1 mg in total of potassium hexachloroiridate (IV) and 1.0 mg in total of potassium ferrocyanide in the grain interior and the silver bromide localized layer). The emulsion was subject to optimum chemical sensitization by adding green-sensitive sensitizing dyes D, E, and F to the large size emulsion in an amounts of $3.0\times10^{-4}$ mol, $4.0\times10^{-5}$ mol, and $2.0\times10^{-4}$ mol per mol of silver and to the large size emulsion in an amounts of $3.6\times10^{-4}$ mol, $7.0\times10^{-5}$ mol, and $2.8\times10^{-4}$ mol per mol of silver, respectively, and adding a sulfur sensitizing agent and a gold sensitizing agent in the presence of a decomposed product of nucleic acid.

The above-prepared emulsified dispersion A-1 was combined with silver chlorobromide emulsion B-1 and dissolved by mixing, obtaining a third layer coating solution of the composition shown below.

Coating solutions for the first through seventh layers were prepared in a similar manner. The gelatin hardener used in the respective layers was sodium 1-oxy-3,5-dichloro-s-triazine. Compounds (Cpd-12) and (Cpd-13) were added to the layers such that their total amounts were 25.0 mg/m$^2$ and 50.0 mg/m$^2$, respectively.

The silver chlorobromide emulsions in the respective photosensitive emulsion layers were adjusted in size by the same method as silver chlorobromide emulsion B-1 while they contained the following spectral sensitizing dyes.

Blue-sensitive emulsion layer

Sensitizing dye A

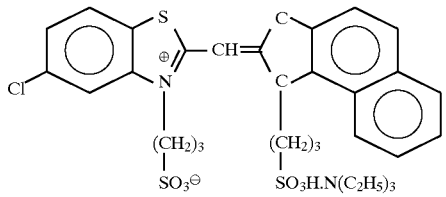

Sensitizing dye B

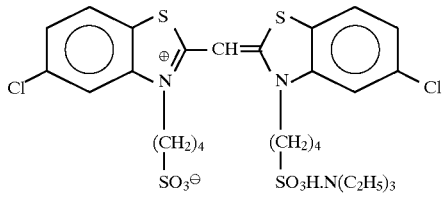

Sensitizing dye C

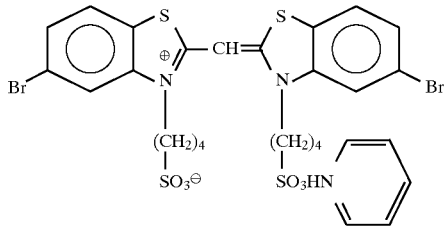

Each of the sensitizing dyes was added to the large size emulsion in an amount of $1.4\times10^{-4}$ mol and to the small size emulsion in an amount of $1.7\times10^{-4}$ mol per mol of silver halide.

Green-sensitive emulsion layer sensitizing dye D

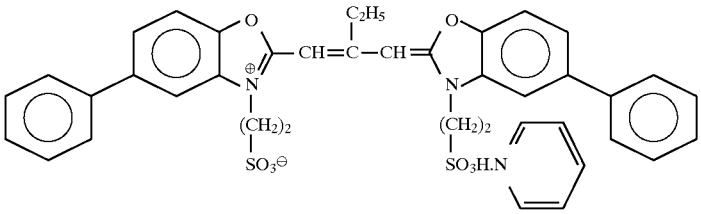

sensitizing dye E

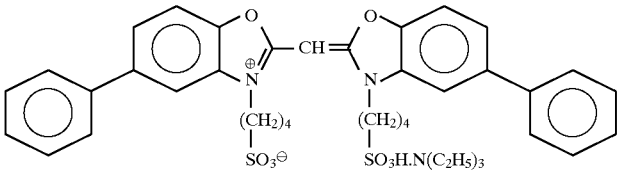

sensitizing dye F

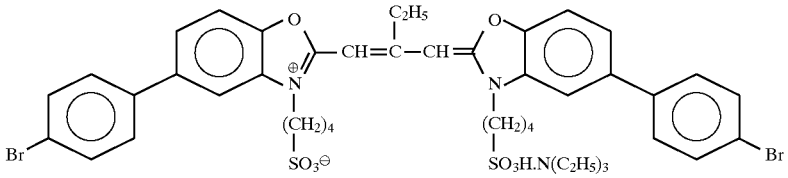

Sensitizing dye D was added to the large size emulsion in an amount of $3.0\times10^{-4}$ mol and to the small size emulsion in an amount of $3.6\times10^{-4}$ mol per mol of silver halide. Sensitizing dye E was added to the large size emulsion in an amount of $4.0\times10^{-5}$ mol and to the small size emulsion in an amount of $7.0\times10^{-5}$ mol per mol of silver halide. Sensitizing dye F was added to the large size emulsion in an amount of $2.0\times10^{-4}$ mol and to the small size emulsion in an amount of $2.8\times10^{-4}$ mol per mol of silver halide.

Red-sensitive emulsion layer sensitizing dye G

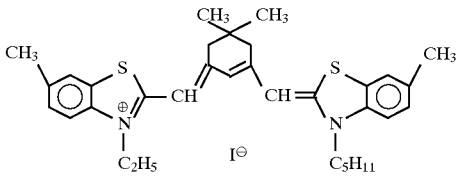

sensitizing dye H

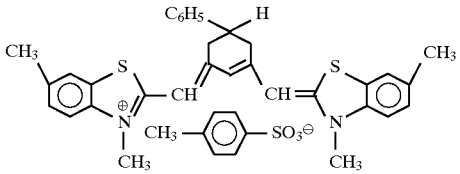

Sensitizing dye G was added to the large size emulsion in an amount of $4.0\times10^{-5}$ mol and to the small size emulsion in an amount of $5.0\times10^{-5}$ mol per mol of silver halide. Sensitizing dye H was added to the large size emulsion in an amount of $5.0\times10^{-5}$ mol and to the small size emulsion in an amount of $6.0\times10^{-5}$ mol per mol of silver halide. The following compound was added to the red sensitive silver halide emulsion in an amount of $2.6\times10^{-3}$ mol per mol of silver halide.

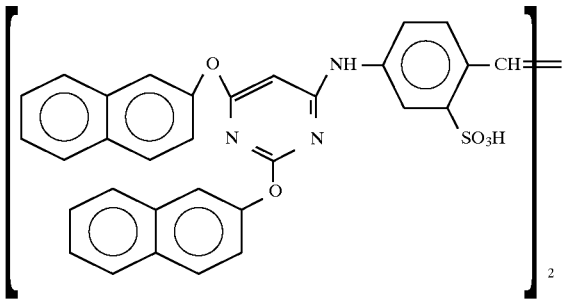

To the blue, green and red sensitive silver halide emulsions, 1-(5-methylureidophenyl)-5-mercaptotetrazole was added in an amount of $8.5\times10^{-4}$ mol, $3.0\times10^{-3}$ mol and $2.5\times10^{-4}$ mol per mol of silver halide, respectively. To the blue and green sensitive silver halide emulsions, 4-hydroxy-6-methyl-1,3,3a,7-tetraazaindene was added in an amount of $1\times10^{-4}$ mol and $2\times10^{-4}$ mol per mol of silver halide, respectively, For preventing irradiation, the following dyes were added to the emulsion layer in the following coverage.

yellow dye

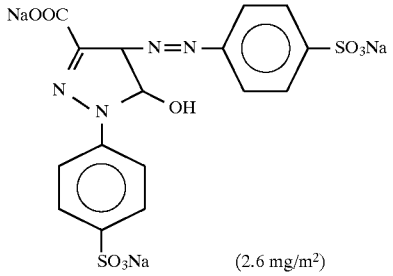

(2.6 mg/m²)

magenta dye

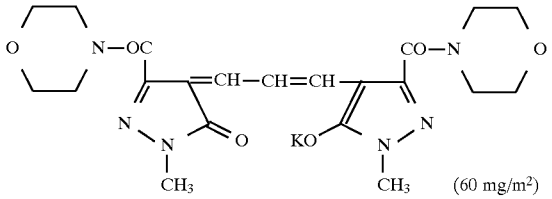

(60 mg/m²)

cyan dye

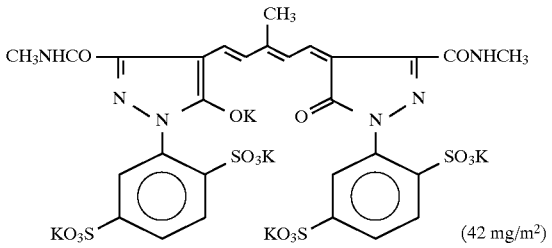

(42 mg/m²)

Layer Arrangement

The composition of the respective layers is shown below. The coating weight is expressed in g/m² except that the silver halide emulsion is given a coating weight based on silver.

Support (A)

A blue-tint dye (ultramarine) was contained in a resin stratum adjacent to the first layer.

| First layer (blue-sensitive emulsion layer) | Coverage |
|---|---|
| Silver chlorobromide emulsion A-1* | 0.27 |
| Gelatin | 1.22 |
| Yellow coupler (EXY) | 0.79 |
| Color image stabilizer (Cpd-1) | 0.08 |
| Color image stabilizer (Cpd-2) | 0.04 |
| Color image stabilizer (Cpd-3) | 0.08 |
| Color image stabilizer (Cpd-5) | 0.01 |
| Solvent (Solv-1) | 0.13 |
| Solvent (Solv-5) | 0.13 |

* cubic, a 5:5 (silver molar ratio) mixture of a large size emulsion with a mean grain size of 0.88 μm and a small size emulsion with a mean grain size of 0.70 μm which had a coefficient of variation of grain size distribution of 0.08 and 0.10, respectively, were based on grains of silver chloride having 0.3 mol % of silver bromide locally contained in the grain surface, and contained 0.1 mg in total of potassium hexachloroiridate (IV) and 1.0 mg in total of potassium ferrocyanide in the grain interior and the silver bromide localized layer

| | Coverage |
|---|---|
| Second layer (color mix inhibiting layer) | |
| Gelatin | 0.90 |
| Color mix inhibiting agent (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| Third layer (green-sensitive emulsion layer) | |
| Silver chlorobromide emulsion B-1 | 0.13 |
| Gelatin | 1.45 |
| Magenta coupler (ExM) | 0.16 |
| UV absorber (UV-2) | 0.16 |
| Color image stabilizer (Cpd-2) | 0.03 |
| Color image stabilizer (Cpd-5) | 0.10 |
| Color image stabilizer (Cpd-6) | 0.01 |
| Color image stabilizer (Cpd-7) | 0.08 |
| Color image stabilizer (Cpd-8) | 0.01 |
| Color image stabilizer (Cpd-10) | 0.02 |
| Solvent (Solv-3) | 0.13 |
| Solvent (Solv-4) | 0.39 |
| Solvent (Solv-6) | 0.26 |
| Fourth layer (color mix inhibiting layer) | |
| Gelatin | 0.68 |
| Color matrix inhibiting agent (Cpd-4) | 0.06 |
| Solvent (Solv-1) | 0.07 |
| Solvent (Solv-2) | 0.11 |
| Solvent (Solv-3) | 0.18 |
| Solvent (Solv-8) | 0.02 |
| Fifth layer (red-sensitive emulsion layer) | |
| Silver chlorobromide emulsion C-1* | 0.18 |
| Gelatin | 0.80 |
| Cyan coupler (ExC) | 0.33 |
| UV absorber (UV-2) | 0.18 |
| Color image stabilizer (Cpd-1) | 0.33 |
| Color image stabilizer (Cpd-2) | 0.03 |
| Color image stabilizer (Cpd-6) | 0.01 |
| Color image stabilizer (Cpd-8) | 0.01 |
| Color image stabilizer (Cpd-9) | 0.02 |
| Color image stabilizer (Cpd-10) | 0.01 |
| Solvent (Solv-1) | 0.01 |
| Solvent (Solv-7) | 0.22 |

* cubic, a 1:4 (silver molar ratio) mixture of a large size emulsion with a mean grain size of 0.50 μm and a small size emulsion with a mean grain size of 0.41 μm which had a coefficient of variation of grain size distribution of 0.09 and 0.11, respectively, were based on grains of silver chloride having 0.8 mol % of silver bromide locally contained in the grain surface, and contained 0.3 mg in total of potassium hexachloroiridate (IV) and 1.5 mg in total of potassium ferrocyanide in the grain interior and the silver bromide localized layer

| | Coverage |
|---|---|
| Sixth layer (UV absorbing layer) | |
| Gelatin | 0.48 |
| UV absorber (UV-1) | 0.38 |
| Color image stabilizer (Cpd-5) | 0.01 |
| Color image stabilizer (Cpd-7) | 0.05 |
| Solvent (Solv-9) | 0.05 |
| Seventh layer (protective layer) | |
| Gelatin | 0.90 |
| Acryl-modified copolymer of polyvinyl alcohol (modification 17%) | 0.05 |
| Liquid paraffin | 0.02 |
| Color image stabilizer (Cpd-11) | 0.01 |

The compounds used in the respective layers are shown below.

(ExY) yellow coupler
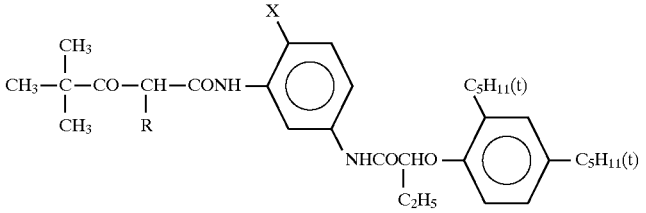
a 1:1 (molar ratio) mixture of
R = 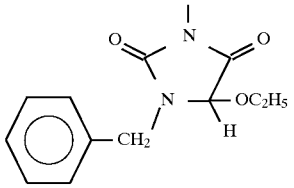 X = Cl
and
R = 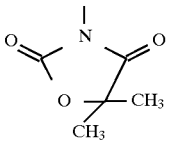 X = $OCH_3$
(ExM) magenta coupler
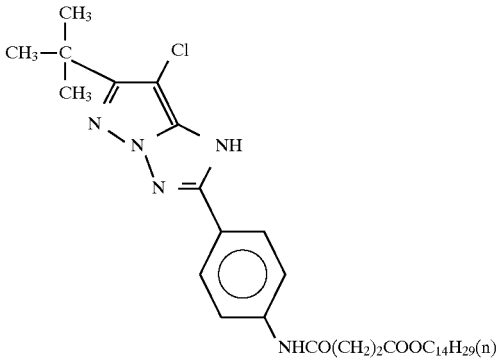
(ExC) cyan coupler
a 25:75 (molar ratio) mixture of
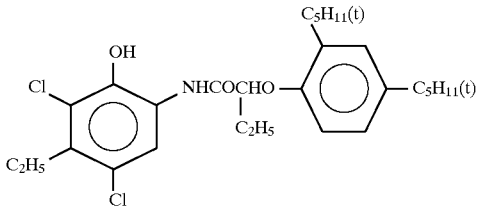
and
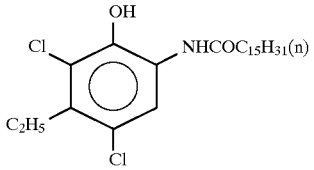

-continued
(Cpd-1) Color image stabilizer
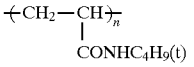
number average molecular weight 60,000
(Cpd-2) Color image stabilizer
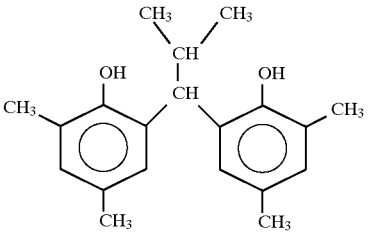
(Cpd-3) Color image stabilizer
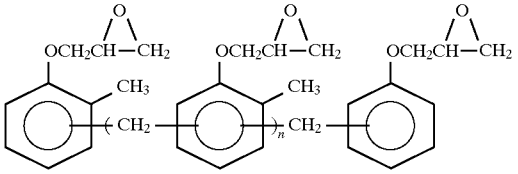
n = 7–8 (average)
(Cpd-4) Color mix inhibiting agent
a 1:1:1 (weight ratio) mixture of
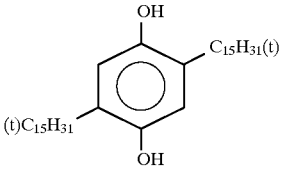
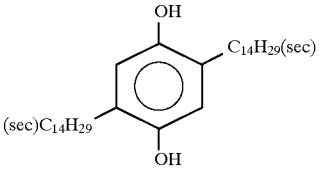
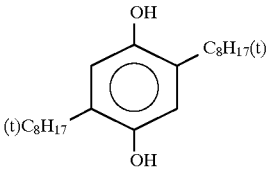
(Cpd-5) Color image stabilizer
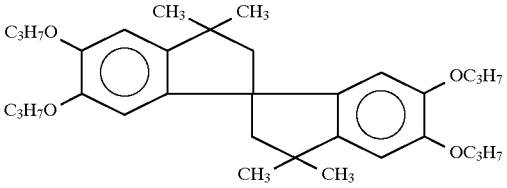
(Cpd-6) Color image stabilizer
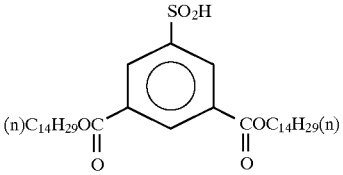

-continued
(Cpd-7) Color image stabilizer
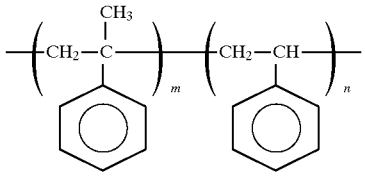
m/n = 9/1
number average molecular weight 600
(Cpd-8) Color image stabilizer
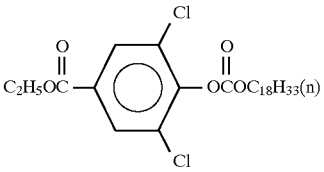
(Cpd-9) Color image stabilizer
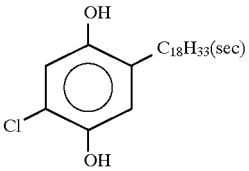
(Cpd-10) Color image stabilizer
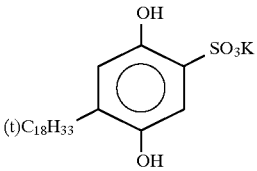
(Cpd-11) a 1:2:1 (weight ratio) mixture of
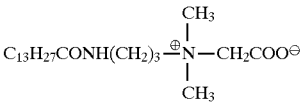
i)
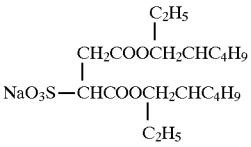
ii)
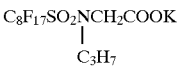
iii)
(Cpd-12) antiseptics
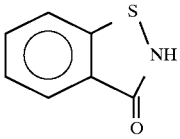
(Cpd-13) antiseptics
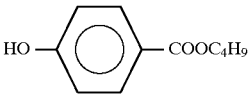
(UV-1) UV absorber
a 1:2:2:3:1 (weight ratio) mixture of -continued
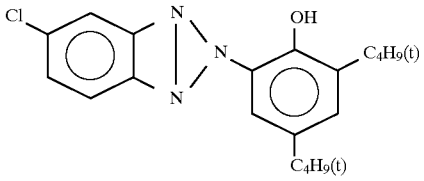
(iv)
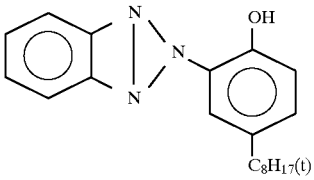
(v)
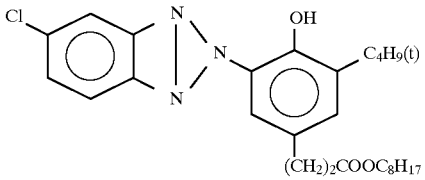
(vi)
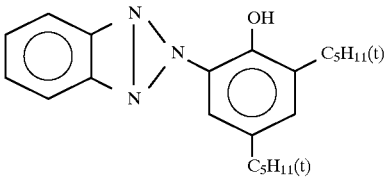
(vii)
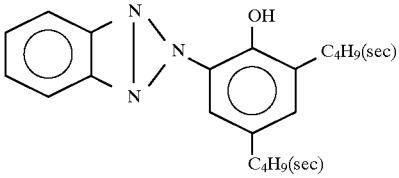
(viii)
(UV-2) UV absorber
a 2:3:4:1 (weight ratio) mixture of
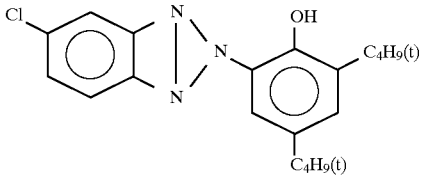
(ix)
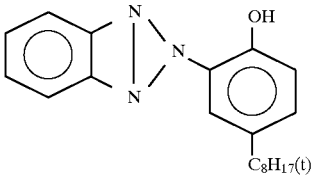
(x)
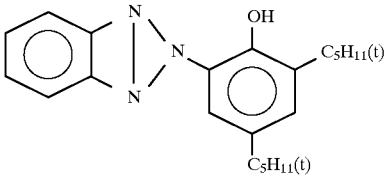
(xi)

-continued
(xii)
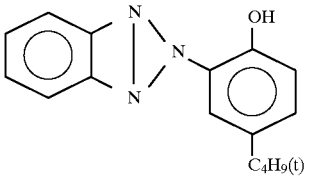
(Solv-1) Solvent
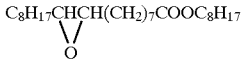
(Solv-2) Solvent
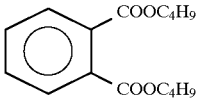
(Solv-3) Solvent
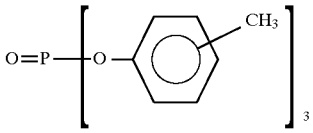
(Solv-4) Solvent
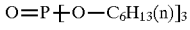
(Solv-5) Solvent
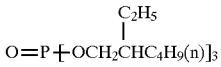
(Solv-6) Solvent
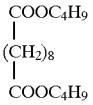
(Solv-7) Solvent
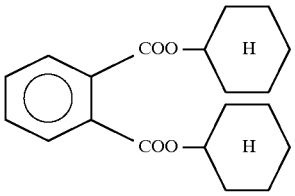
(Solv-8) Solvent
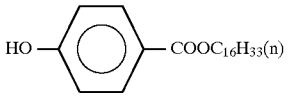
(Solv-9) Solvent
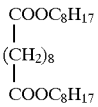

The test results are shown in Table 1.

TABLE 1

| Sample No. | Water-soluble polymer Type | Amount added (g) | Amount added (wt % based on processing components) | Viscosity (ps, 25° C.) Aqueous solution | Processing composition |
|---|---|---|---|---|---|
| 1 | Na carboxymethyl cellulose (n = 1200, de = 1.3) | 1.8 | 0.5 | 100 | 30 |
| 2 | Na carboxymethyl cellulose (n = 1200, de = 0.6) | 1.8 | 0.5 | 13 | 21 |
| 3 | Hydroxyethyl cellulose (n = 2000) | 0.36 | 0.1 | 5 | 20 |
| 4 | Polyvinyl alcohol (n = 3500) | 36 | 10 | 1 | 18 |
| 5 | Polyvinyl pyrrolidone (n = 2100) | 36 | 10 | 0.1 | 16 |
| 6 | Na polyacrylate (n = 1500) | 7.2 | 2.0 | 1.2 | 10 |
| 7* | Na carboxymethyl cellulose (n = 1200, de = 1.3) | 0.18 | 0.05 | 10 | 4 |
| | Hydroxyethyl cellulose (n = 2000) | 0.18 | 0.05 | 5 | 5 |
| | Na carboxymethyl cellulose (n = 1200, de = 1.3) | 72 | 20 | 10 | 2950 |
| 10* (n = 2000) | Hydroxyethyl cellulose | 72 | 20 | 5 | 1800 |
| 11* | none | — | — | — | 5 |

| Sanple No. | Processing composition As-prepared: Discharge Residual weight (g) | Processing composition As-prepared: Separation Solids fraction (%) | After storage: Discharge Residual weight (g) | After storage: Separation Solids fraction (%) |
|---|---|---|---|---|
| 1 | 0.8 | 100 | 0.9 | 99 |
| 2 | 2.9 | 100 | 4.8 | 96 |
| 3 | 4.9 | 100 | 9.2 | 92 |
| 4 | 9.8 | 100 | 13.8 | 91 |
| 5 | 9.6 | 100 | 12.2 | 91 |
| 6 | 9.2 | 98 | 10.0 | 92 |
| 7* | 22.9 | 78 | 246.5 | 38 |
| 8* | 23.8 | 76 | 249.5 | 34 |
| 9* | 156.2 | 100 | 225.0 | 100 |
| 10* | 181.0 | 100 | 230.0 | 100 |
| 11* | 25.3 | 75 | 251.5 | 31 |

| Sample No. | Solubility Dissolving time (min.) | Dmax (%) Cyan | Dmax (%) Magenta | Dmax (%) Yellow |
|---|---|---|---|---|
| 1 | 1 | 100 | 100 | 100 |
| 2 | 2 | 100 | 99 | 97 |
| 3 | 4 | 98 | 95 | 95 |
| 4 | 8 | 99 | 99 | 99 |
| 5 | 9 | 98 | 100 | 100 |
| 6 | 7 | 99 | 100 | 100 |
| 7* | 180 | 100 | 100 | 100 |
| 8* | 180 | 100 | 100 | 100 |
| 9* | 200 | 90 | 90 | 85 |
| 10* | 200 | 88 | 90 | 75 |
| 11* | 180 | 100 | 100 | 100 |

Note:
n: degree of polymerization
de: degree of etherification
*comparison

As is evident from Table 1, processing composition slurries containing 0.1 to 10% by weight of a water-soluble polymer based on the weight of the processing components are improved in liquid discharge, separation stability, solubility and photographic properties. Among water-soluble polymers, carboxymethyl celluloses, especially carboxymethyl celluloses having a degree of etherification of at least 0.8 are excellent.

Example 2

A concentrate of a color developer replenisher for color negative film was prepared. On use, the concentrate was diluted by a factor of 10 to form a ready-to-use solution. The formulation of the concentrate per 10 liters of ready-to-use solution is shown below.

| Formulation | |
|---|---|
| Diethylenetriamine pentaacetate | 40 g |
| Sodium sulfite | 50 g |
| Potassium bromide | 5.0 g |
| Sodium pyrocatechol-3,5-disulfonate | 3.0 g |
| Disodium N,N-bis (sulfonatoethyl) - Hydroxylamine | 100 g |
| Potassium carbonate | 400 g |
| 2-methyl-4-[N-ethyl-N-(β-hydroxyethyl)-amino]aniline hydrogen sulfate | 60 g |

Raw materials of the above-mentioned components were admitted into a 3-liter twin-arm open kneader where they were pulverized and mixed for 10 minutes. A water-soluble polymer as shown in Table 3 was added to the mixture, which was mixed for a further 5 minutes. Distilled water, 200 ml, was further added to the mixture, which was kneaded for 15 minutes. The resulting paste was gradually diluted with 800 ml of distilled water. There was obtained a uniform slurry of photographic processing composition for color negative development. In this way, slurry processing composition sample Nos. 21 to 31 were obtained as shown in Table 3. These samples had a volume of 1.0 liter. Note that the water-soluble polymer was omitted in sample No. 31.

Water-soluble polymer-containing sample Nos. 21 to 30 and water-soluble polymer-free sample No. 31 were tested as in Example 1 except that test 6) of examining the influence on photographic properties was changed as follows. 6) Influence on photographic properties A color developer was prepared by diluting the sample to 10 liters and completely dissolving in the same manner as in 5). A coated sample B was prepared as a photosensitive material to be evaluated for photographic properties.

Coated sample B was exposed by means of a sensitometer (model FWH by Fuji Photo Film Co., Ltd., light source color temperature 4800K) through a continuous wedge and processed by the following steps with the following solutions. The processor used was a mini-labo processor model PP560B by Fuji Photo Film Co., Ltd. At the end of processing, the image was measured for maximum density of cyan, magenta and yellow using a Macbeth densitometer. The maximum density is expressed in percent relative to a maximum density of 100% for the water-soluble polymer-free sample.

| Processing step | Temperature | Time |
|---|---|---|
| Color development | 38.0° C. | 3 min. 5 sec. |
| Dleaching | 38.0° C. | 50 sec. |
| Fixation (1) | 38.0° C. | 50 sec. |
| Fixation (2) | 38.0° C. | 50 sec. |
| Washing | 38.0° C. | 30 sec. |
| Stabilizing (1) | 38.0° C. | 20 sec. |
| Stabilizing (2) | 38.0° C. | 20 sec. |
| Drying | 60° C. | 1 min. |

The stabilizing solution was counter-flow from (2) to (1). Overflow of the wash water was entirely channeled into fixation (2). The fixer was also counter-flow from (2) to (1). The carry-over of the developer to the bleaching step, the carry-over of the bleaching solution to the fixation step, and the carry-over of the fixer to the washing step were 2.5 ml, 2.0 ml, and 2.0 ml per 1.1 meters of 35-mm wide photosensitive material, respectively. The crossover times each were 6 seconds. The crossover time was included in the processing time of every preceding step.

| Color developer | |
|---|---|
| Color developer replenisher | 750 ml |
| Potassium bromide | 1.0 g |
| Potassium iodide | 1.3 mg |
| Potassium carbonate | 9.5 g |
| Water | totaling to 1000 ml |
| | pH 10.05 |
| pH was adjusted with potassium hydroxide and sulfuric acid. | |
| **Bleaching solution** | |
| Ammonium ferric 1,3-diaminopropane-tetraacetate monohydrate | 118 g |
| Ammonium bromide | 80 g |
| Ammonium nitrate | 15 g |
| Succinic acid | 40 g |
| Maleic acid | 33 g |
| Water | totaling to 1000 ml |
| pH 4.4 | |
| pH was adjusted with agueous ammonia. | |
| **Fixer** | |
| Ammonium sulfite | 19 g |
| Ammonium thiosulfate in water (700 g/l) | *280 ml |
| Imidazole | 7 g |
| Ethylenediamine tetraacetic acid | 15 g |
| Ammonium methanesulfinate | 10 g |
| Ammonium methanethiosulfonate | 4 g |
| Water | totaling to 1000 ml |
| | pH 7.4 |
| pH was adjusted with agueous ammonia and acetic acid. | |

Wash Water

City water was passed through a mixed bed column filled with a H type strongly acidic cation exchange resin (Amberlite IR-120B by Rohm & Haas Co.) and a OH type strongly basic anion exchange resin (Amberlite IR-400) to calcium and magnesium ion concentrations of less than 3 mg/liter. To the water were added 20 mg/liter of sodium isocyanurate dichloride and 150 mg/liter of sodium sulfate. The resulting wash water was at pH 6.5 to 7.5.

| Stabilizing solution | |
|---|---|
| Sodium p-toluenesulfinate | 0.03 g |
| Polyoxyethylene-p-monononylphenyl ether (average degree of polymerization 10) | 0.2 g |
| Disodium ethylenediamine tetraacetate | 0.05 g |
| 1,2 4-triazole | 1.3 g |
| 1,4-bis (1,2,4-triazol-1-ylmethyl)-piperadine | 0.75 g |
| 1,2-benzoisothiazolin-3-one | 0.10 g |
| Water | totaling to 1000 ml |
| | pH 8.5 |

Coated sample B was prepared by the following procedure.

1) Support

The support used herein was a polyethylene naphthalate (PEN) film which was prepared by drying 100 parts by weight of polyethylene-2,6-naphthalate polymer and 2 parts by weight of Tinuvin P.326 (by Ciba-Geigy), melting the mixture at 300° C., extruding the melt through a T die, stretching the film at 140° C. in a longitudinal direction by a factor of 3.3, then stretching the film at 130° C. in a transverse direction by a factor of 3.3, and finally thermosetting the film at 250° C. for 6 seconds. The PEN film was 90 μm thick. It is noted that appropriate amounts of blue, magenta and yellow dyes (dyes I-1, I-4, I-6, I-24, I-26, I-27, and II-5 described in Technical Report No. 94-6023) were added to the PEN film. The film was wound on a stainless steel mandrel having a diameter of 20 cm and caused to experience thermal hysteresis at 110° C. for 48 hours so that the film might not curl.

2) Coating of Undercoat Layer

The support on either surface was subject to corona discharge treatment, UV discharge treatment and glow discharge treatment. Using a bar coater, the support was coated with an undercoating solution containing 0.1 g/m$^2$ of gelatin, 0.01 g/m$^2$ of sodium α-sulfodi-2-ethylhexyl-succinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensate in a coverage of 10 cc/m$^2$. The undercoat layer was on the surface of the support which had been on a higher temperature side during stretching. The coating was dried at 115° C. for 6 minutes by setting rollers and other members of a conveyor in the drying zone at 115° C.

3) Coating of Back Layer

After undercoating, the other surface of the support was coated with an antistatic layer, a magnetic recording layer, and a lubricant layer as a back layer.

3-1) Coating of Antistatic Layer

A coating solution contained 0.2 g/m$^2$ of a dispersion of tin oxide-antimony oxide composite particles having a mean particle size of 0.005 μm and a resistivity of 5 Ω-cm (secondary agglomerate particle size ~0.08 μm), 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol having a degree of polymerization of 10, and resorcin. The solution was coated to form an antistatic layer having a resistance of $10^{8.1}\Omega$ at 25° C. and RH 10%.

3-2) Coating of Magnetic Recording Layer

Cobalt-γ-iron oxide (specific surface area 43 m$^2$/g, major axis 0.14 μm, minor axis 0.03 μm, saturation magnetization 89 emu/g, $Fe^{+2}/Fe^{+3}$=6/94, surface treated with 2% by weight of the iron oxide of aluminum oxide/silicon oxide) was coated with 15% by weight of 3-polyoxyethylene-propyltrimethoxysilane having a degree of polymerization of 15. A coating composition contained 0.06 g/m$^2$ of the cobalt-γ-iron oxide, 0.3 g/m$^2$ of $C_2H_5C(CH_2OCONH{-}C_6H_3(CH_3)NCO)_3$ as a curing agent, and acetone, methyl ethyl ketone, and cyclohexanone as a solvent. The composition further contained silica particles having a particle size of 0.3 μm as a matte agent and aluminum oxide coated with 15% by weight of 3-polyoxyethylene-propyltrimethoxysilane having a degree of polymerization of 15 and having a particle size of 0.15 μm as an abrasive in amounts of 10 mg/m$^2$. Using a bar coater, the composition was applied to form a magnetic recording layer of 1.2 μm thick. The coating was dried at 115° C. for 6 minutes by setting rollers and other members of a conveyor in the drying zone at 115° C. The magnetic recording layer has a $D^E$ color density increment of about 0.1 as measured using X light (blue filter), a saturation magnetization moment of 4.2 emu/g, a coercive force of $7.3\times10^{-4}$ A/m, and a squareness ratio of 65%.

3-3) Coating of lubricant layer (Preparation of comparative sample)

A mixture of 25 mg/m$^2$ of diacetyl cellulose, 6 mg/m$^2$ of $C_6H_{13}CH(OH)C_{10}H_{20}COOC_{40}H_{81}$ (compound-a) and 9 mg/m$^2$ of $C_{50}H_{101}O(CH_2CH_2O)_{16}H$ (compound-b) was applied by melting the mixture at 105° C. in xylene/propylene monomethyl ether (volume ratio 1/1), adding the melt to a 10-times volume of propylene monomethyl ether at room temperature, agitating for dispersion, and forming a dispersion (mean particle size 0.01 μm) in acetone.

4) Coating of Photosensitive Layer

On the surface of the support opposite to the back layer, layers of the following compositions were coated in an overlapping manner, completing a color negative film.

Photosensitive Layer Composition

Main components used in the respective layers are classified into the following groups.

ExC: cyan coupler

ExM: magenta coupler

ExY: yellow coupler

ExS: sensitizing dye

UV: ultraviolet absorber

HBS: high-boiling organic solvent

H: gelatin hardener

The numerical value corresponding to each component is a coverage as expressed in g/m$^2$. As to the silver halide, its coverage is calculated as silver. As to the sensitizing dye, its coverage is expressed in mol per mol of silver halide in the same layer.

| | |
|---|---|
| 1st layer (anti-halation layer) | |
| Black colloid silver | 0.09 (Ag) |
| gelatin | 1.60 |
| ExM-1 | 0.12 |
| ExF-1 | $2.0 \times 10^{-3}$ |
| solid disperse dye ExF-2 | 0.030 |
| solid disperse dye ExF-3 | 0.040 |
| HBS-1 | 0.15 |
| HBS-2 | 0.02 |
| 2nd layer (intermediate layer) | |
| Silver iodobromide emulsion M | 0.065 (Ag) |
| ExC-2 | 0.04 |
| Polyethyl acrylate latex | 0.20 |
| gelatin | 1.04 |
| 3rd layer (low sensitivity red-sensitive emulsion layer) | |
| Silver iodobromide emulsion A | 0.25 (Ag) |
| Silver iodobromide eniulsion B | 0.25 (Ag) |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| gelatin | 0.87 |
| 4th layer (medium sensitivity red-sensitive emulsion layer) | |
| Silver iodobromide emulsion C | 0.70 (Ag) |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| gelatin | 0.75 |
| 5th layer (high sensitivity red-sensitive emulsion layer) | |
| Silver iodobromide emulsion D | 1.40 (Ag) |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |

-continued

| | |
|---|---|
| ExC-6 | 0.020 |
| ExC-7 | 0.010 |
| Cpd-2 | 0.050 |
| HBS-1 | 0.22 |
| HBS-2 | 0.050 |
| gelatin | 1.10 |
| 6th layer (intermediate layer) | |
| Cpd-1 | 0.090 |
| solid disperse dye ExF-4 | 0.030 |
| HBS-21 | 0.050 |
| Polyethyl acrylate latex | 0.15 |
| gelatin | 1.10 |
| 7th layer (low sensitivity green-sensitive emulsion layer) | |
| Silver iodobromide emulsion E | 0.15 (Ag) |
| Silver iodobromide emulsion F | 0.10 (Ag) |
| Silver iodobromide emulsion G | 0.10 (Ag) |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| gelatin | 0.73 |
| 8th layer (medium sensitivity green-sensitive emulsion layer) | |
| Silver iodobromide emulsion H | 0.80 (Ag) |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| gelatin | 0.80 |
| 9th layer (high sensitivity green-sensitive emulsion layer) | |
| Silver iodobromide emulsion I | 1.25 (Ag) |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl acrylate latex | 0.15 |
| gelatin | 1.33 |
| 10th layer (yellow filter layer) | |
| Yellow colloid silver | 0.015 (Ag) |
| Cpd-1 | 0.16 |
| solid disperse dye ExF-5 | 0.060 |
| solid disperse dye ExF-6 | 0.060 |
| oil soluble dye ExF-7 | 0.010 |
| HBS-1 | 0.60 |
| gelatin | 0.60 |
| 11th layer (low sensitivity blue-sensitive emulsion layer) | |
| Silver iodobromide emulsion J | 0.09 (Ag) |
| Silver iodobromide emuision K | 0.09 (Ag) |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| gelatin | 1.20 |

-continued

| | |
|---|---|
| 12th layer (high sensitivity blue-sensitive emulsion layer) | |
| Silver iodobromide emulsion L | 1.00 (Ag) |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| gelatin | 0.70 |
| 13th layer (first protective layer) | |
| UV-1 | 0.19 |
| UV-2 | 0.075 |
| UV-3 | 0.065 |
| HBS-1 | 0.05 |
| HBS-4 | 0.05 |
| gelatin | 1.8 |
| 14th layer (second protective layer) | |
| Silver iodobromide emulsion M | 0.10 (Ag) |
| H-1 | 0.40 |
| B-1 (diameter 1.7 μm) | 0.05 |
| B-2 (diameter 1.7 μm) | 0.15 |
| B-3 | 0.05 |
| S-1 | 0.20 |
| gelatin | 0.70 |

Proper compounds selected from compounds W-1 to W-3, B-4 to B-6, F-1 to F-17, iron salts, lead salts, gold salts, platinum salts, palladium salts, iridium salts, and rhodium salts were contained in each of the layers for improving storage stability, processability, pressure resistance, antibacterial and antifungal properties, antistatic property and coating efficiency.

The silver halide emulsions A to M used in the respective layers are shown in Table 2.

TABLE 2

| | Average AgI content (%) | Coefficient of variation of AgI content among grains (%) | Mean grain size as equivalent sphere diameter (μm) |
|---|---|---|---|
| Emulsion A | 1.7 | 10 | 0.46 |
| Emulsion B | 3.5 | 15 | 0.57 |
| Emulsion C | 8.9 | 25 | 0.66 |
| Emulsion D | 8.9 | 18 | 0.84 |
| Emulsion E | 1.7 | 10 | 0.46 |
| Emulsion F | 3.5 | 15 | 0.57 |
| Emulsion G | 8.8 | 25 | 0.61 |
| Emulsion H | 8.8 | 25 | 0.61 |
| Emulsion I | 8.9 | 18 | 0.84 |
| Emulsion J | 1.7 | 10 | 0.46 |
| Emulsion K | 8.8 | 18 | 0.64 |
| Emulsion L | 14.0 | 25 | 1.28 |
| Emulsion M | 1.0 | — | 0.07 |

| | Coefficient of variation of grain size (%) | Projected area size as equivalent circle diameter (μm) | Diameter/thickness |
|---|---|---|---|
| Emulsion A | 15 | 0.56 | 5.5 |
| Emulsion B | 20 | 0.78 | 4.0 |
| Emulsion C | 25 | 0.87 | 5.8 |
| Emulsion D | 26 | 1.03 | 3.7 |
| Emulsion E | 15 | 0.56 | 5.5 |
| Emulsion F | 20 | 0.78 | 4.0 |
| Emulsion G | 23 | 0.77 | 4.4 |
| Emulsion H | 23 | 0.77 | 4.4 |
| Emulsion I | 26 | 1.03 | 3.7 |
| Emulsion J | 15 | 0.50 | 4.2 |
| Emulsion K | 23 | 0.85 | 5.2 |

TABLE 2-continued

| | | | |
|---|---|---|---|
| Emulsion L | 26 | 1.46 | 3.5 |
| Emulsion M | 15 | — | 1 |

Note:

(1) Emulsions J to L were subject to reduction sensitization with thiourea dioxide and thiosulfonic acid during grain preparation according to Example of JP-A 191938/1990.

(2) Emulsions A to I were subject to gold, sulfur and selenium sensitization in the presence of the spectral sensitizing dye described for each photosensitive layer and sodium thiocyanate according to Example of JP-A 237450/1991.

(3) Preparation of tabular grains used low molecular weight gelatin according to Example of JP-A 158426/1989.

(4) In tabular grains, transition lines as described in JP-A 237450/1991 were observed under a high voltage electron microscope.

(5) Emulsion L was of dual structure grains having an interior high iodine core as described in JP-A 143331/1985.

Preparation of a Dispersion of Organic Solid Disperse Dye

Solid disperse dye ExF-2 was dispersed as follows. A 700-ml pot mill was charged with 21.7 ml of water, 3 ml of a 5% aqueous solution of sodium p-octylphenoxyethoxyethoxyethanesulfonate, and 0.5 gram of a 5% aqueous solution of p-octylphenoxypolyoxyethylene ether having a degree of polymerization of 10. The mill was further charged with 5.0 grams of dye ExF-2 and 500 ml of zirconium oxide beads having a diameter of 1 mm and operated to disperse the contents for 2 hours. A BO type vibrating ball mill by Chuo Kogyo K.K. was used for dispersion. After dispersion, the contents were taken out, 8 grams of 12.5% gelatin aqueous solution was added, and the beads were filtered off, obtaining a gelatin dispersion of the dye. The submicron particles of the dye had a mean particle size of 0.44 μm.

Similarly, solid particle dispersions of dyes ExF-3, ExF-4, and ExF-6, were obtained. The submicron particles of these dyes had a mean particle size of 0.24 μm, 0.45 μm, and 0.52 μm, respectively. Dye ExF-5 was dispersed by micro-precipitation dispersion method described in Example 1 of EP 549,489 A. This had a mean particle size of 0.06 μm.

The compounds used in the respective layers are shown below.

ExC-1

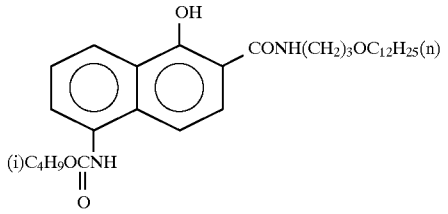

ExC-2

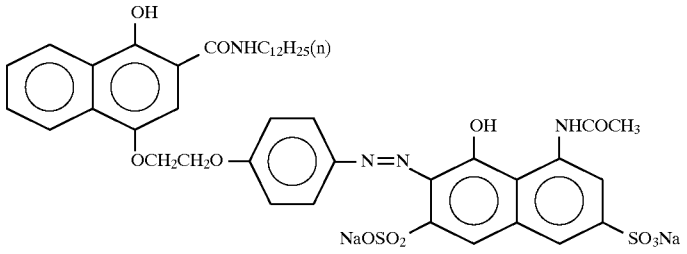

ExC-3

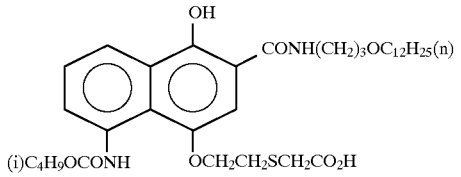

ExC-4

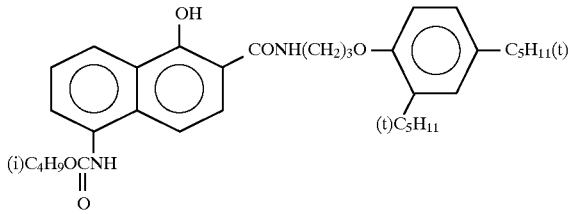

-continued
ExC-5
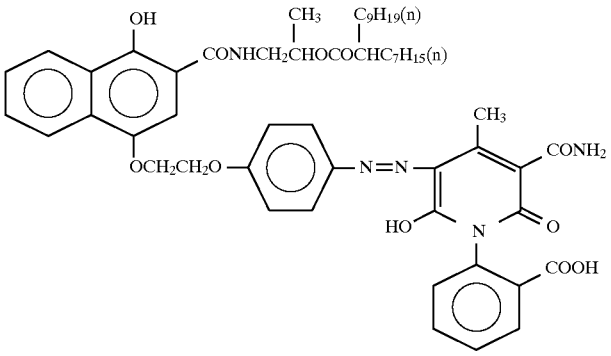
ExC-6
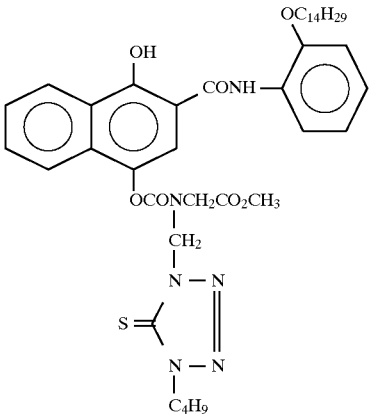
ExC-7
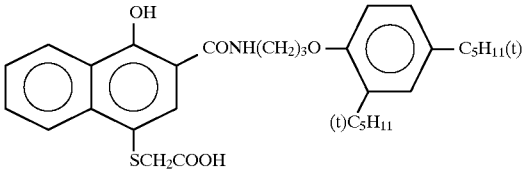
ExC-8
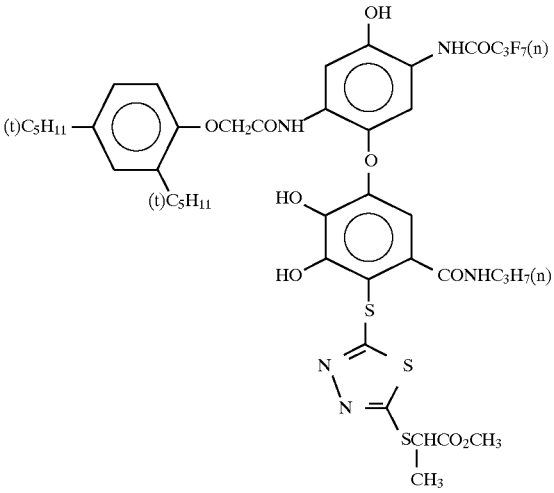

-continued
ExM-1
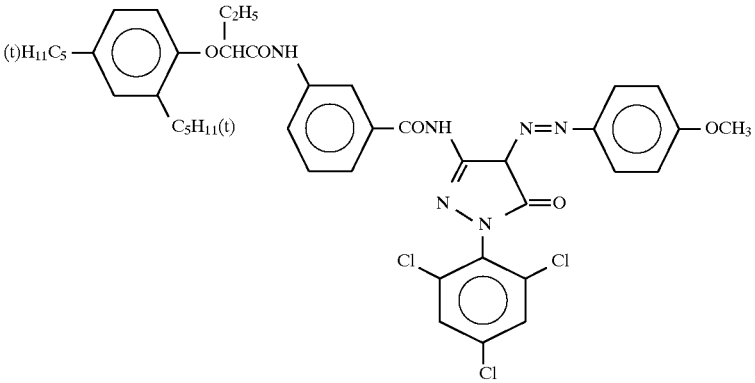
ExM-2
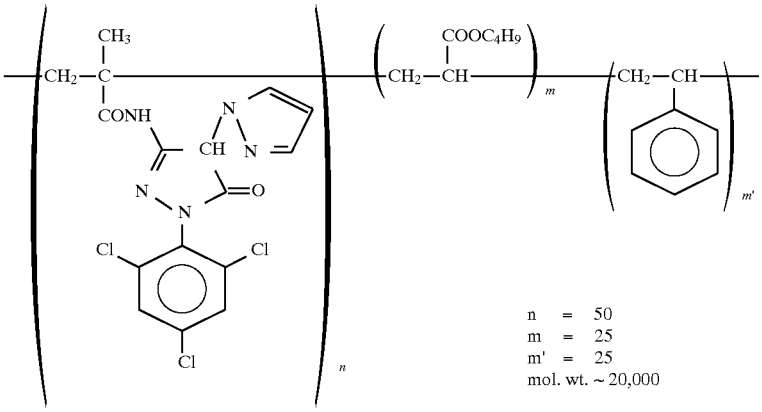
n = 50
m = 25
m' = 25
mol. wt. ~ 20,000
ExM-3
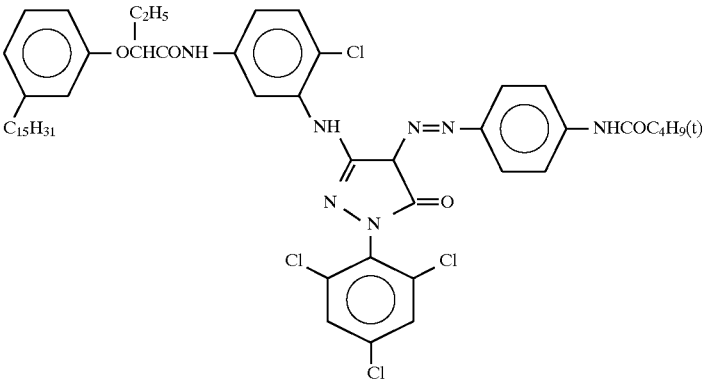
ExM-4
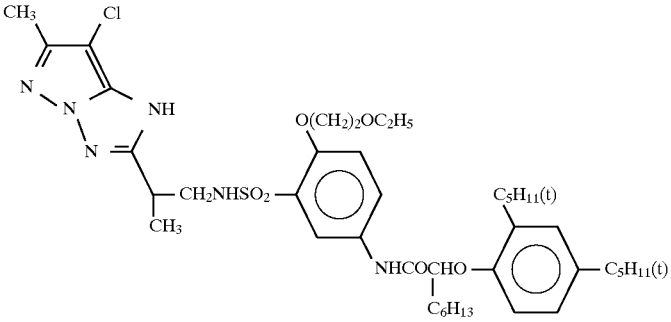

-continued
ExM-5
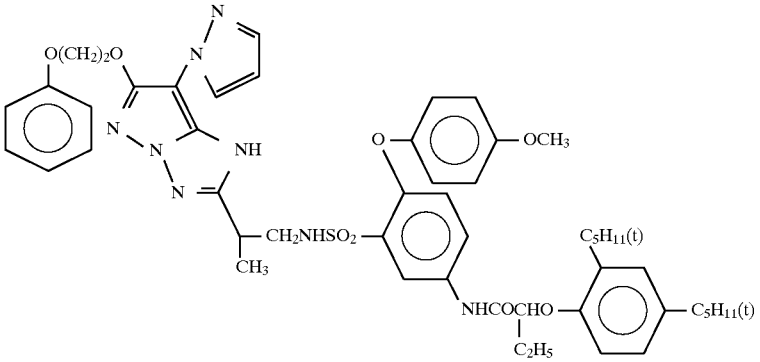
ExY-1
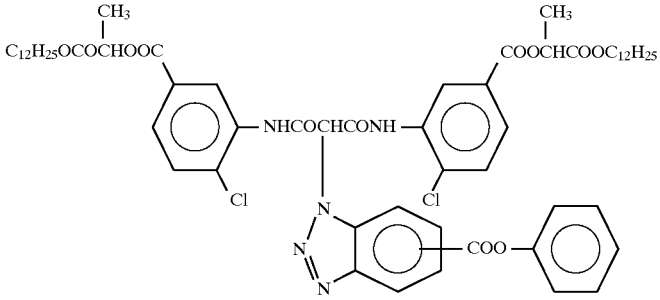
ExY-2
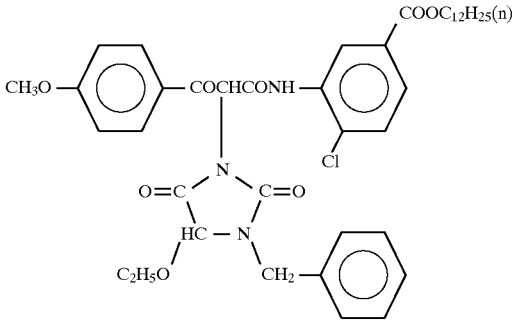
ExY-3
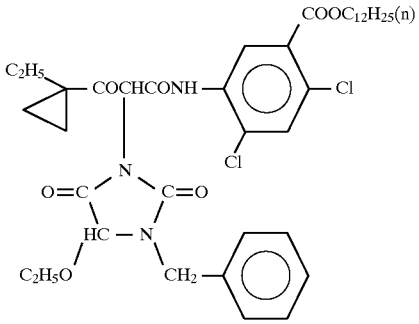
ExY-4
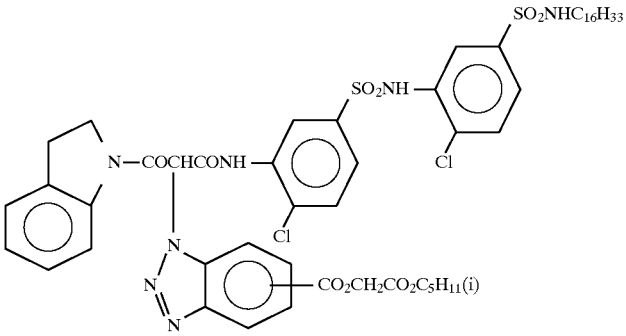

-continued
ExY-5
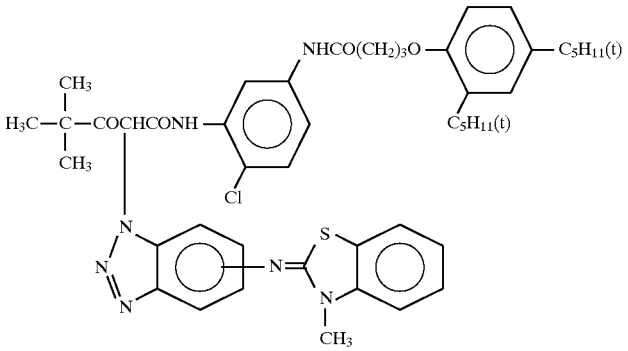
ExF-1
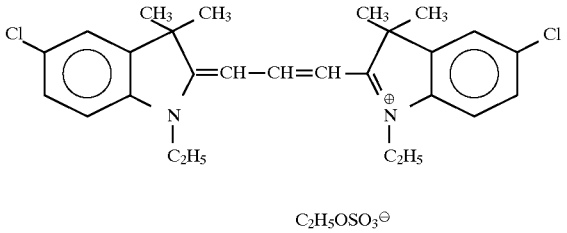
ExF-2
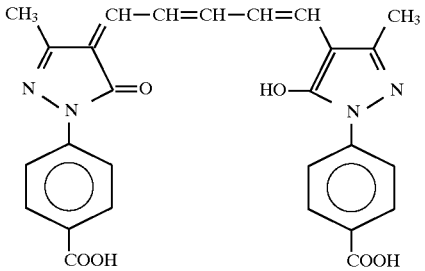
ExF-3
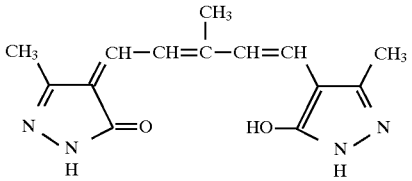
ExF-4
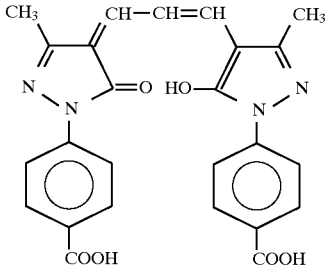
ExF-5
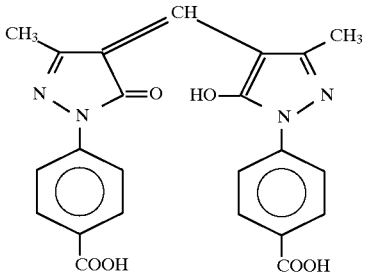

-continued
ExF-6
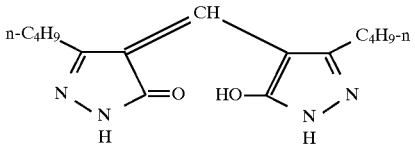
ExF-7
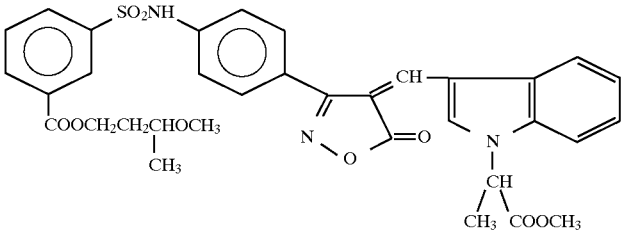
Cpd-1
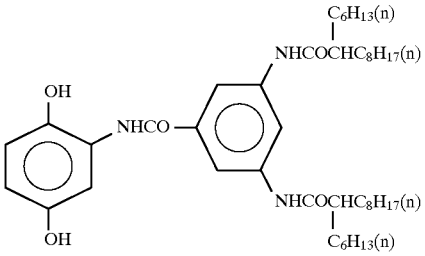
Cpd-2
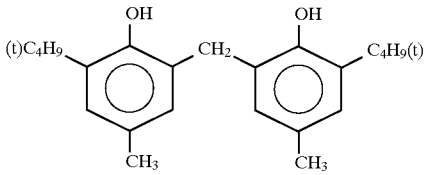
Cpd-3
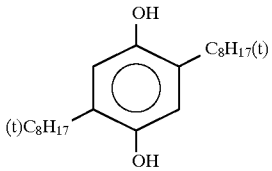
UV-1
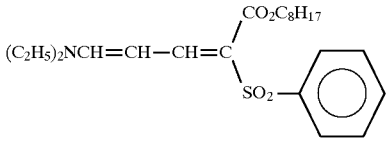
UV-2
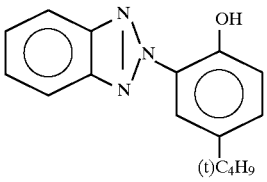
UV-3
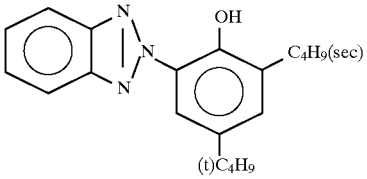
tricresylphosphate HBS-1
di-n-butylphthalate HBS-2

-continued
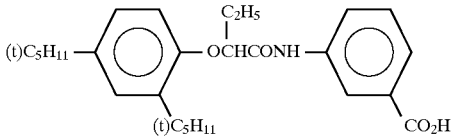
HBS-3
tri(2-ethylhexyl)phosphate
HBS-4
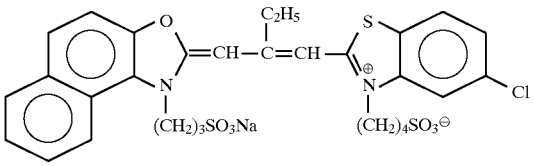
ExS-1
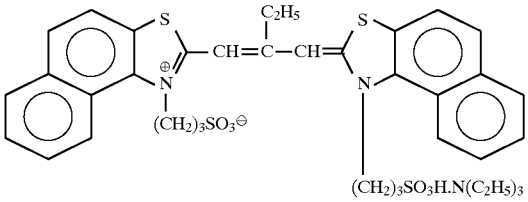
ExS-2
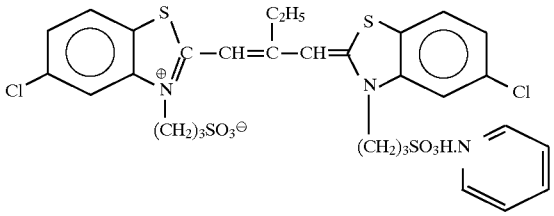
ExS-3
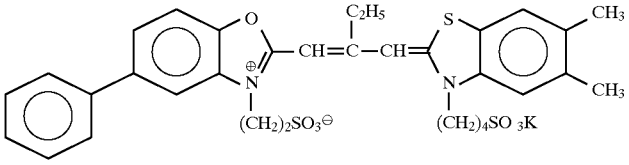
Exs-4
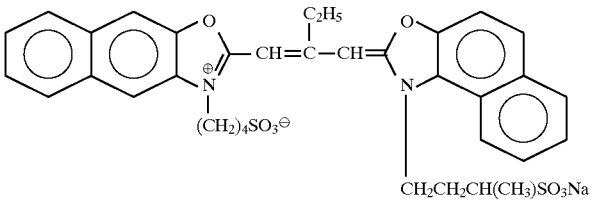
ExS-5
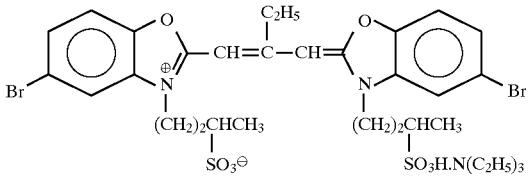
ExS-6
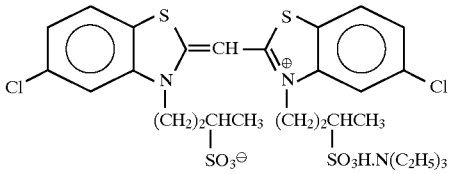
ExS-7

-continued
S-1
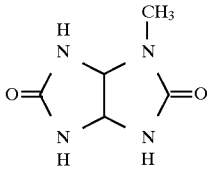
H-1
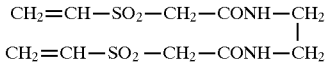
B-1
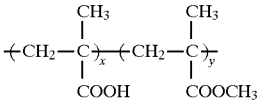
x/y = 10/90 (weight ratio)
average molar
ratio: ~35,000
B-2
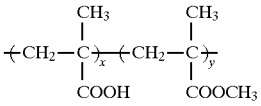
x/y = 40/60 (weight ratio)
average molar
ratio: ~20,000
B-3
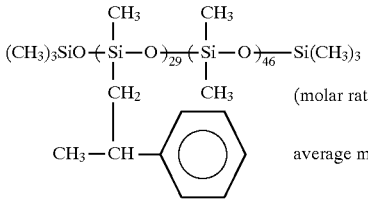
(molar ratio)
average molar ratio: ~8,000
B-4
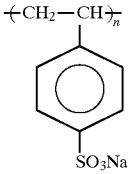
average molar ratio: ~750,000
B-5
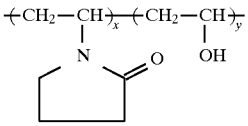
x/y = 70/30 (weight ratio)
average molar
ratio: ~17,000
B-6
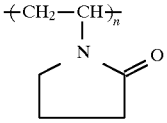
average molar ratio: ~10,000
W-1
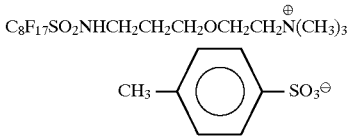
W-2
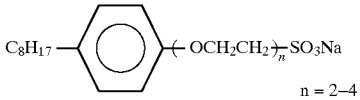
n = 2–4
W-3
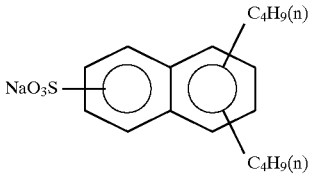

-continued
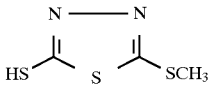
F-1
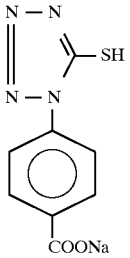
F-2
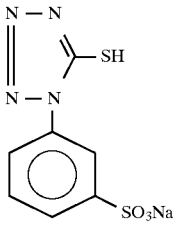
F-3
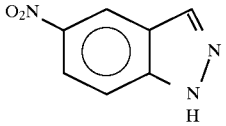
F-4
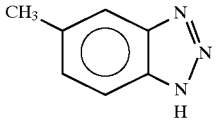
F-5
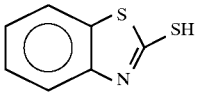
F-6
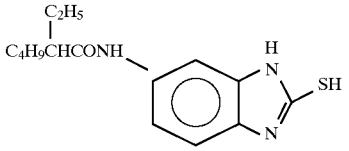
F-7
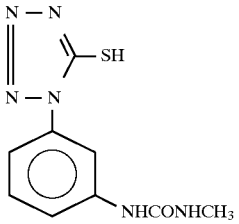
F-8
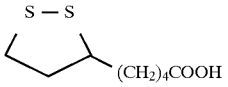
F-9
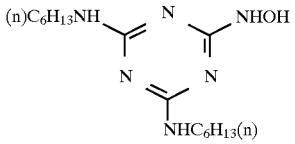
F-10

-continued

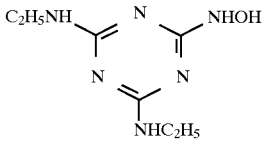

F-11

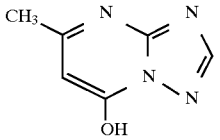

F-12

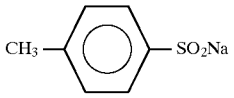

F-13

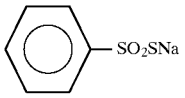

F-14

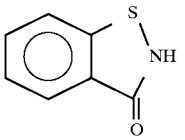

F-15

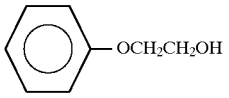

F-16

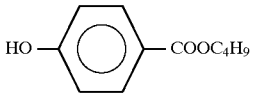

F-17

The thus prepared photosensitive material was cut into strips of 24 mm wide and 160 cm long. Each strip was formed with a pair of 5.8-mm spaced apart perforations of 2 mm×2 mm at a position of 0.7 mm transversely spaced from one longitudinal side. Such pairs of perforations were provided at intervals of 32 mm in the longitudinal direction. The perforated film strip was received in a plastic cartridge as described in U.S. Pat. No. 5,296,887, FIGS. 1 through 7. This photo-sensitive material is designated coated sample B.

The test results are shown in Table 3.

TABLE 3

| Sample No. | Water-soluble polymer Type | Amount added (g) | Amount added (wt % based on processing components) | Viscosity (ps, 25° C.) Aqueous solution | Processing composition |
|---|---|---|---|---|---|
| 21 | Na carboxymethyl cellulose (n = 1200, de = 1.3) | 3.3 | 0.5 | 100 | 25 |
| 22 | Na carboxymethyl cellulose (n = 1200, de = 0.6) | 3.3 | 0.5 | 13 | 18 |
| 23 | Hydroxyethyl cellulose (n = 2000) | 6.6 | 1.0 | 5 | 22 |
| 24 | Polyvinyl alcohol (n = 3500) | 13 | 2.0 | 1 | 9 |
| 25 | Polyvinyl pyrrolidone (n = 2100) | 66 | 10 | 0.1 | 16 |
| 26 | Na polyacrylate (n = 1500) | 13 | 2.0 | 1.2 | 8 |
| 27* | Na carboxymethyl cellulose (n = 1200, de = 1.3) | 0.33 | 0.05 | 100 | 4 |
| 28* | Hydroxyethyl cellulose (n = 2000) | 0.33 | 0.05 | 5 | 4 |

TABLE 3-continued

| | | | | | |
|---|---|---|---|---|---|
| 29* | Na carboxymethyl cellulose (n = 1200, de = 1.3) | 79 | 12 | 100 | 2900 |
| 30* | Hydroxyethyl cellulose (n = 2000) | 79 | 12 | 5 | 2000 |
| 31* | none | — | — | — | 3 |

| | Processing composition As-prepared | | After storage | |
|---|---|---|---|---|
| Sample No. | Discharge Residual weight (g) | Separation Solids fraction (%) | Discharge Residual weight (g) | Separation Solids fraction (%) |
| 21 | 0.5 | 100 | 1.3 | 100 |
| 22 | 2.2 | 100 | 5.2 | 95 |
| 23 | 5.3 | 100 | 10.8 | 90 |
| 24 | 9.9 | 100 | 14.9 | 93 |
| 25 | 8.4 | 100 | 13.3 | 92 |
| 26 | 9.8 | 99 | 15.1 | 90 |
| 27* | 18.6 | 81 | 229.0 | 50 |
| 28* | 19.3 | 80 | 250.4 | 51 |
| 29* | 121.0 | 100 | 205.0 | 100 |
| 30* | 150.1 | 100 | 210.4 | 100 |
| 31* | 22.0 | 80 | 256.8 | 49 |

| Sample No. | Solubility Dissolving time (min.) | Dmax (%) Cyan | Magenta | Yellow |
|---|---|---|---|---|
| 21 | 0.5 | 100 | 100 | 100 |
| 22 | 2 | 98 | 98 | 100 |
| 23 | 3 | 93 | 98 | 98 |
| 24 | 10 | 99 | 98 | 99 |
| 25 | 7 | 99 | 100 | 100 |
| 26 | 8 | 98 | 98 | 98 |
| 27* | 120 | 100 | 99 | 100 |
| 28* | 120 | 100 | 100 | 100 |
| 29* | 190 | 62 | 70 | 80 |
| 30* | 190 | 60 | 72 | 78 |
| 31* | 120 | 100 | 100 | 100 |

Note:
n: degree of polymerization
de: degree of etherification
*comparison

As is evident from Table 3, processing composition slurries containing 0.1 to 10% by weight of a water-soluble polymer based on the weight of the processing components are improved in liquid discharge, separation stability, solubility and photographic properties. Among water-soluble polymers, carboxymethyl celluloses, especially carboxymethyl celluloses having a degree of etherification of at least 0.8 are excellent.

BENEFITS OF THE INVENTION

There has been described a slurry-form photographic processing composition which has sufficient fluidity to flow out of a container merely when the container is inclined. The slurry composition is easy to manipulate when the composition is transferred from the container into a developing processor. With respect to its preparation, the processing composition is easy to handle and highly productive.

As compared with ready-to-use solution, the slurry composition is reduced in volume and weight, contributing to substantial savings of transportation cost and storage space. The container may have a smaller volume. The reduced volume of containers and the reduced quantity of resinous material to form containers are not only economical, but are also advantageous for environmental protection because of a less burden for the collection and disposal of used containers.

Due to low viscosity, the slurry composition is soluble enough to produce photographs of quality without causing the trouble of insoluble matter attaching to film.

During long-term storage, the slurry composition remains stable without solidification and sedimentation.

Although some preferred embodiments have been described, many modifications and variations may be made thereto in the light of the above teachings. It is therefore to be understood that within the scope of the appended claims, the invention may be practiced otherwise than as specifically described.

We claim:

1. A slurry-form photographic processing composition comprising photographic processing components, some of which are dispersed in a medium in fine particulate form, and 0.1 to 10% by weight based on the weight of said processing components of a water-soluble polymer, wherein said water-soluble polymer has a degree of etherification of at least 0.8.

2. The slurry composition of claim 1 having a viscosity of 0.1 to 100 poise as measured at 25° C. and a low shear rate by a Brookfield viscometer.

3. The slurry composition of claim 1 wherein an aqueous solution of 1% by weight of said water-soluble polymer has a viscosity of 1 to 150 poise as measured at 25° C. and a low shear rate by a Brookfield viscometer.

4. The slurry composition of claim 1 wherein said water-soluble polymer is selected from the group consisting of a cellulosic resin, polyvinyl alcohol, polyvinyl pyrrolidone, acrylic resin, polystyrene sulfonate resin, and modified products thereof.

5. The slurry composition of claim 4 wherein said water-soluble polymer is carboxymethyl cellulose or a modified product thereof.

6. The slurry composition of claim 5 wherein said water-soluble polymer is carboxymethyl cellulose or a modified product thereof.

7. A method for processing a silver halide photosensitive material, comprising the steps of:

diluting the slurry-form photographic processing composition of claim 1 with water to form a processing solution, imagewise exposing a silver halide photosensitive material, and processing the exposed photosensitive material with the processing solution.

8. The method of claim 7 wherein in the diluting step, the slurry composition is diluted with water by a volume factor of 3 to 10.

* * * * *